US010443349B2

(12) United States Patent
Evans et al.

(10) Patent No.: US 10,443,349 B2
(45) **Date of Patent: *Oct. 15, 2019**

(54) REMOTE HYDRAULIC CONTROL OF DOWNHOLE TOOLS

(71) Applicant: Halliburton Energy Services, Inc., Houston, TX (US)

(72) Inventors: Benjamin Evans, Harinsart (BE); Olivier Christophe Roche, Schaerbeek (BE); Jean-Pierre Lassoie, Anderlecht (BE)

(73) Assignee: Halliburton Energy Services, Inc., Houston, TX (US)

( * ) Notice: Subject to any disclaimer, the term of this patent is extended or adjusted under 35 U.S.C. 154(b) by 45 days.

This patent is subject to a terminal disclaimer.

(21) Appl. No.: 15/555,947

(22) PCT Filed: Apr. 15, 2015

(86) PCT No.: PCT/US2015/025990

§ 371 (c)(1),
(2) Date: Sep. 5, 2017

(87) PCT Pub. No.: WO2016/167764

PCT Pub. Date: Oct. 20, 2016

(65) Prior Publication Data

US 2018/0038201 A1 Feb. 8, 2018

(51) Int. Cl.
*E21B 10/32* (2006.01)
*E21B 34/06* (2006.01)
(Continued)

(52) U.S. Cl.
CPC ..... *E21B 34/102* (2013.01); *E21B 10/322* (2013.01); *E21B 23/006* (2013.01); *E21B 41/00* (2013.01); *E21B 2034/007* (2013.01)

(58) Field of Classification Search
CPC ..... E21B 34/102; E21B 34/14; E21B 10/322; E21B 23/006; E21B 41/00; E21B 2034/007
See application file for complete search history.

(56) References Cited

U.S. PATENT DOCUMENTS 6,557,332 B2 5/2003 Rhody
9,453,380 B2 * 9/2016 Hardin, Jr. ..... E21B 21/08
(Continued)

FOREIGN PATENT DOCUMENTS

WO 2014133487 9/2014

OTHER PUBLICATIONS

International Search Report and Written Opinion of PCT Application No. PCT/US2015/025990 dated Dec. 10, 2017: pp. 1-10.

*Primary Examiner* — Brad Harcourt
(74) *Attorney, Agent, or Firm* — Chamberlain Hrdlicka

(57) ABSTRACT

A well tool apparatus comprises a control arrangement configured to control response of the downhole tool by varying downhole drilling fluid conditions. The control arrangement includes a valve piston longitudinally slidable in a generally tubular controller housing that is in operation substantially co-axial with the wellbore, to open or close a valve port to a fluid flow connection between the drill strings interior and the tool. A latch mechanism is configured to latch the valve piston in an activated mode and/or a deactivated mode. Unlatching of the valve piston can be effected by displacement thereof in a particular axial direction to a mode change position. A stay member is automatically displaceable in the particular actual direction under hydraulic actuation responsive to above-threshold drilling fluid conditions, to obstruct movement of the valve piston under hydraulic actuation to the mode change position. The stay member can include a lock piston carrying a ball locking
(Continued)

mechanism for obstructing axial movement of the valve piston.

19 Claims, 16 Drawing Sheets

(51) Int. Cl.

| | |
|---|---|
| ***E21B 34/10*** | (2006.01) |
| ***E21B 23/00*** | (2006.01) |
| ***E21B 41/00*** | (2006.01) |
| *E21B 34/00* | (2006.01) |

(56) References Cited

U.S. PATENT DOCUMENTS

| | | | | |
|---|---|---|---|---|
| 2002/0014338 | A1 | 2/2002 | Purkis et al. | |
| 2009/0090501 | A1 | 4/2009 | Hansen et al. | |
| 2010/0300702 | A1 | 12/2010 | Andrews et al. | |
| 2011/0030963 | A1 | 2/2011 | Demong et al. | |
| 2011/0127044 | A1* | 6/2011 | Radford ..... | E21B 10/322 166/373 |

* cited by examiner

REMOTE HYDRAULIC CONTROL OF DOWNHOLE TOOLS

TECHNICAL FIELD

The present application relates generally to downhole tools in drilling operations, and to methods of operating downhole tools. Some embodiments relate more particularly to fluid-activated control systems, mechanisms and methods for downhole tools. The disclosure also relates to downhole reamer deployment control by fluid-pressure sequencing.

BACKGROUND

Boreholes for hydrocarbon (e.g., oil and gas) production are usually drilled with a drill string that includes a tubular member (also referred to as a drilling tubular) having a drilling assembly which includes a drill bit attached to the bottom end thereof. The drill bit is rotated to shear or disintegrate material of the rock formation to drill the wellbore. The drill string often includes tools or other devices that require remote activation and deactivation during drilling operations. Such tools and devices include, among other things, reamers, stabilizers or force application members used for steering the drill bit.

Such drilling environments can often present numerous challenges to the use of electromechanical control systems. Remote control of downhole tool activation by controlling fluid pressure in the drill string often allow only a single activation/deactivation cycle, after which the control system is to be reset, while reduction in effective drill string diameter result in some systems.

Alternative tool control methods include the utilization of drilling fluid (e.g., mud cycled down the drill string and back up a borehole annulus) as a control channel for the tool. In such cases, inadvertent triggering of tool activation/deactivation (for example, in response to operational fluid pressure variations not intended by the operator to control the tool) is to be prevented.

BRIEF DESCRIPTION OF THE DRAWINGS

Some embodiments are illustrated by way of example and not limitation in the figures of the accompanying drawings in which.

DETAILED DESCRIPTION

Aspects of the example embodiments described with reference to the drawings include methods and systems to control downhole tool activation by remote fluid pressure control. One aspect of the described embodiments provides a downhole tool control mechanism that comprises a latch mechanism disposable between an activated mode and a deactivated mode, and a locking mechanism for locking the latch mechanism in at least one of the activated mode and the deactivated mode. In some embodiments, the locking mechanism may be configured for locking the latch mechanism in the activated mode, and for locking the latch mechanism in the deactivated mode. Locking of the latch mechanism in a particular mode may comprise allowing mode switching of the latch mechanism exclusively by providing predefined downhole fluid conditions and/or a predefined time-sensitive sequence of downhole fluid pressure/flow values.

In some embodiments, the control mechanism comprises a valve member or valve piston which is axially displaceable in an activation direction to switch from a closed condition to an open condition in which a valve port or opening in fluid connection with the downhole tool is exposed by the valve piston, thereby to effect a desired tool response (e.g., to deploy a downhole tool such as, for example, a reamer). In some embodiments, the locking mechanism comprises a locking member or lock piston that is axially displaceable in the activation direction under hydraulic actuation by agency of drilling fluid. The locking mechanism may include a locking member or stay member configured for hydraulically actuated axial movement in the same direction as hydraulically actuated movement of the valve piston.

In some embodiments, the locking mechanism includes a locking ball held captive by the lock piston for axial movement therewith, the lock piston being axially displaceable to move the locking ball between a clearing position in which relative axial movement of the valve piston is unimpeded by the locking ball, and an obstructing position, in which the locking ball is arranged for obstruction of the valve piston.

Figure 1:
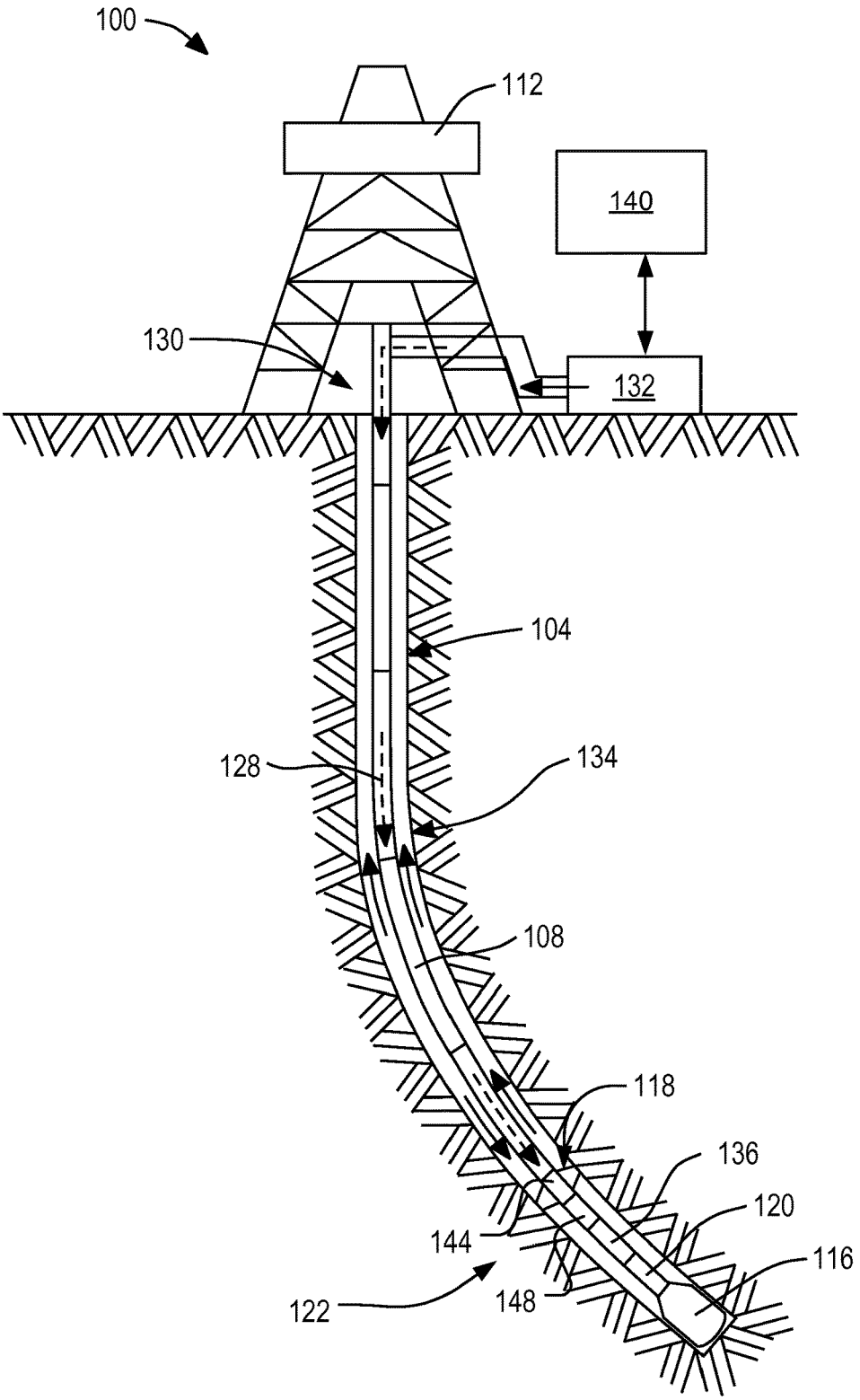
FIG. 1 depicts a schematic diagram of a drilling installation that includes a drilling apparatus that provides a control arrangement for remote fluid-activated control of tool activation, in accordance with an example embodiment.

FIG. 1 is a schematic view of an example embodiment of a system that utilizes borehole fluid as a control channel for downhole tool operation. A drilling installation 100 includes a subterranean borehole 104 in which a drill string 108 is located. The drill string 108 may comprise jointed sections of drill pipe suspended from a drilling platform 112 secured at a wellhead. A downhole assembly or bottom hole assembly (BHA) 122 at a bottom end of the drill string 108 may include a drill bit 116 to disintegrate earth formations at a leading end of the drill string 108, to pilot the borehole 104, and one or more reamer assemblies 118, uphole of the drill bit 116 to widen the borehole 104 by operation of selectively expandable cutting elements.

The borehole 104 is thus an elongated cavity that is substantially cylindrical, having a substantially circular cross-sectional outline that remains more or less constant along the length of the borehole 104. The borehole 104 may in some cases be rectilinear, but may often include one or more curves, bends, doglegs, or angles along its length. As used with reference to the borehole 104 and components therein, the "axis" of the borehole 104 (and therefore of the drill string 108 or part thereof) means the approximate centerline of the cylindrical borehole 104. "Axial" thus means a direction at least approximately along a line parallel with the lengthwise direction of the borehole 104 at the relevant point or portion of the borehole 104 under discussion; "radial" means a direction at least approximately along a line that intersects the borehole axis and lies in a plane substantially perpendicular to the borehole axis; "tangential" means a direction at least approximately along a line that is radially spaced from the borehole axis and that lies in a plane substantially perpendicular to the borehole axis; and "circumferential" means a substantially arcuate or circular path described at least approximately by rotation of a tangential vector about the borehole axis.

As used herein, movement or location "downhole" means axial movement or relative axial location towards the drill bit 116, away from the surface. Conversely, "uphole" means movement or relative location axially along the borehole 104, away from the drill bit 116 and to towards the earth's surface.

A measurement and control assembly 120 may be included in the BHA 122, which also includes measurement instruments to measure borehole parameters, drilling performance, and the like.

Drilling fluid (for example, drilling mud, or other fluids that may be in the well), is circulated from a drilling fluid reservoir 132, for example a mud pit, at the earth's surface, and coupled to the wellhead, indicated generally at 130, by means of a pump (not shown) that forces the drilling fluid down a drilling bore 128 provided by a hollow interior of the drill string 108, so that the drilling fluid exits under high pressure through the drill bit 116. After exiting from the drill string 108, the drilling fluid occupies a borehole annulus 134 defined between the drill string 108 and a wall of the borehole 104. Although many other annular spaces may be associated with the system 102, references to annular pressure, annular clearance, and the like, refer to features of the borehole annulus 134, unless the context or the description indicates otherwise.

Note that the drilling fluid is pumped along the inner diameter (i.e., the bore 128) of the drill string 108, with fluid flow out of the bore 128 being restricted at the drill bit 116. Fluid pressure during operation is therefore typically greater in the bore 128 than in the annulus 134. Unless the context indicates otherwise, the term "pressure differential" means the difference between general fluid pressure in the bore 128 and pressure in the annulus 134. After exiting the drill bit 116, the drilling fluid then flows upwards along the annulus 134, carrying cuttings from the bottom of the borehole 104 to the wellhead 130, where the cuttings are removed and the drilling fluid may be returned to the drilling fluid reservoir 132.

In some instances, the drill bit 116 is rotated by rotation of the drill string 108 from the platform 112. In this example embodiment, a downhole motor 136 (such as, for example, a so-called mud motor or turbine motor) is incorporated in the drill string 108 (here, forming part of the BHA 122), being driven by the pressurized drilling fluid to, in turn, drive rotation of the drill bit 116. In some embodiments, the rotation of the drill string 108 may be selectively powered by one or both of surface equipment and the downhole motor.

The system 102 may include a surface control system 140 to receive signals from sensors and devices incorporated in the drill string 108 (typically forming part of the BHA 122). The surface control system 140 may display drilling parameters and other information on a display or monitor that is used by an operator to control the drilling operations. Some drilling installations may be partly or fully automated, so that drilling control operations (e.g., control of operating parameters of the motor 136 and control of downhole tool deployment through pressure sequencing of the drilling fluid, as described herein) may be either manual, semi-automatic, or fully automated. The surface control system 140 comprises a computer system having one or more data processors and data memories. The surface control system 140 can process data relating to the drilling operations, data from sensors and devices at the surface, data received from downhole, and may control one or more operations of downhole tools and devices that are downhole and/or surface devices.

The drill string 108 may include one or more downhole tools instead of or in addition to the reamer assemblies 118 mentioned previously. The downhole tools of the drill string 108, in this example, thus includes at least one reamer assembly 118 located in the BHA 122 to enlarge the diameter of the borehole 104 as the BHA 122 penetrates the formation. In other embodiments, a reamer assembly 118 may be positioned uphole of and coupled to the BHA 122. Each reamer assembly 118 may comprise one or more circumferentially spaced blades or other cutting elements that carry cutting structures. The reamer assembly 118 houses a reamer 144 that is selectively extended and retracted radially from a housing of the reamer assembly 118, to selectively increase and decrease in diameter.

In this embodiment, deployment of the reamer 144 is hydraulically actuated by use of the pressurized drilling fluid. The drilling fluid is also used as a control channel to select a deployment mode of the reamer 144. The drilling fluid thus serves both as hydraulic actuation medium and as control channel for the reamer 144. In this example, deployment control mechanisms to achieve such fluid-pressure control of the reamer 144 are provided by a controller 148 that comprises an assembly having a drill-pipe body or housing 215 (see FIG. 2) connected in-line in the drill string 108. In this embodiment, the controller 148 is mounted downhole of the associated reamer assembly 118.

Fluid Pressure Considerations

Using the drilling fluid as tool control channel and hydraulic drive can necessitate mechanisms that enable similar fluid pressures in different instances to trigger different tool responses, and to allow operator-selection of the tool response. There is seldom, for example, a simple direct correspondence between fluid pressure values and desired reamer deployment. Although reaming operations in this example coincide with high fluid pressure in the bore 128 (also referred to as bore pressure or internal pressure), the reamer 144 is not to be deployed with every occurrence of high bore pressure. The bore pressure may, for example, be ramped up to drive the drill bit 116 via the motor 136 when the borehole 104 is being drilled. Reamer deployment during such a drilling phase is often to be avoided.

A function of the controller 148, in this embodiment, is to selectively adjust the way in which the reamer 144 responds to certain fluid pressure conditions. The reamer assembly 118 may be bi-modal, selectively being disposed in either a deactivated mode (also referred to as a dormant mode) or an activated mode (also referred to as an active mode). In the deactivated mode, the reamer 144 is retracted and remains retracted regardless of high bore pressures (e.g., pressures at operating levels for downhole machine such as the motor 136). In the activated mode, the reamer 144 is dynamically responsive to bore pressure, so that high bore pressures automatically and invariably result in deployment of the reamer 144 by radial extension of the reamer 144's cutting elements. Control of the reamer assembly 118 to selectively dispose it to one of the modes or the other may be by producing in the drilling fluid a predefined pressure profile over time or a predefined sequence of bore pressure values. In an example, mode switching comprises application of a low pressure (relative to tool operating pressures) for longer than a predefined trigger interval. Much of the description that follows discusses mechanisms to implement such triggered mode control of the reamer assembly 118.

Overview of Controller Operation

Figure 2A:
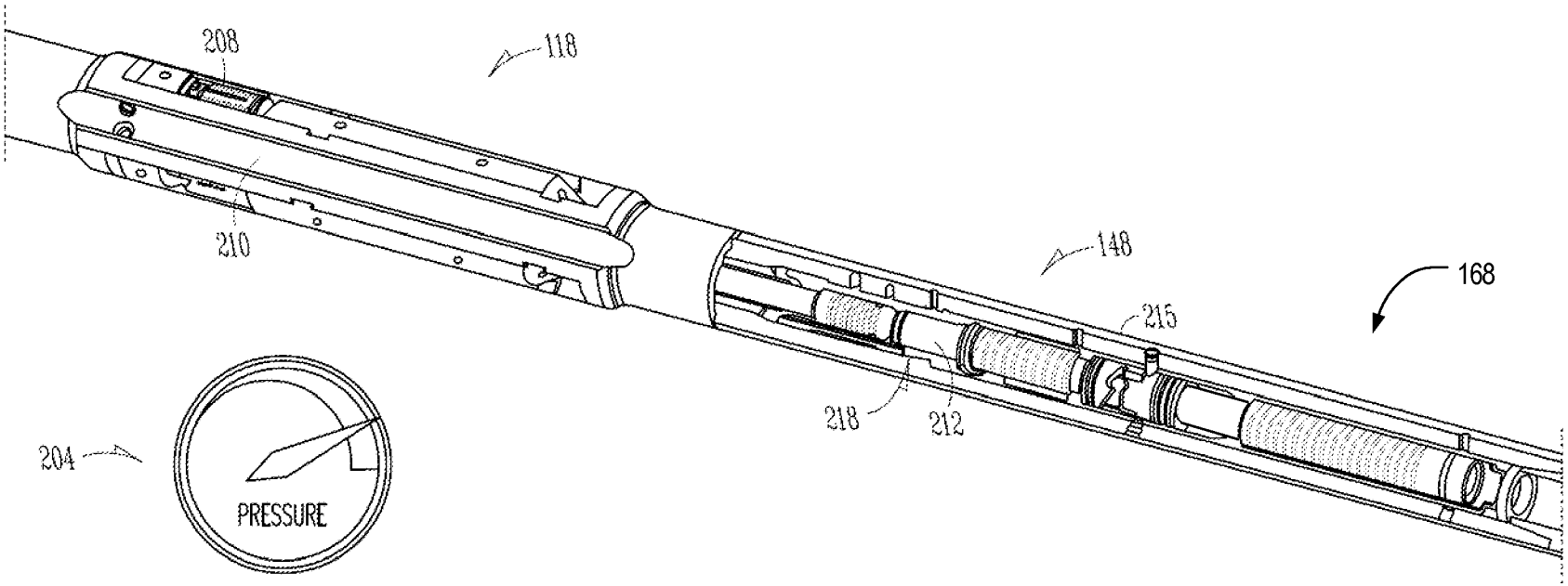
FIGS. 2A-2B depict partially sectioned three-dimensional views of a drilling apparatus for remote fluid-activated control of tool activation, in accordance with an example embodiment, an example tool in the form of a reamer being deployed in FIG. 2A and being retracted in FIG. 2B.

FIG. 2A shows the reamer assembly 118 in the deactivated mode. As indicated by schematic pressure gauge 204, the drill string 108 has a high bore pressure, in this example corresponding to an operational pressure of the reamer assembly 118. "Operational pressure" here means pressure at or greater than bore pressures at which the relevant tool is to perform its primary function, in the case of the reamer assembly 118 being bore pressures during reaming. Despite such operational pressure levels, the reamer 144 in FIG. 2A is in a retracted condition, in which reamer cutting elements in the example form of reamer arms 208 are retracted into a tubular reamer body 210. The reamer arms 208 do not project beyond a radially outer surface of the reamer body 210, and therefore do not engage the wall of the borehole 104.

Figure 2B:
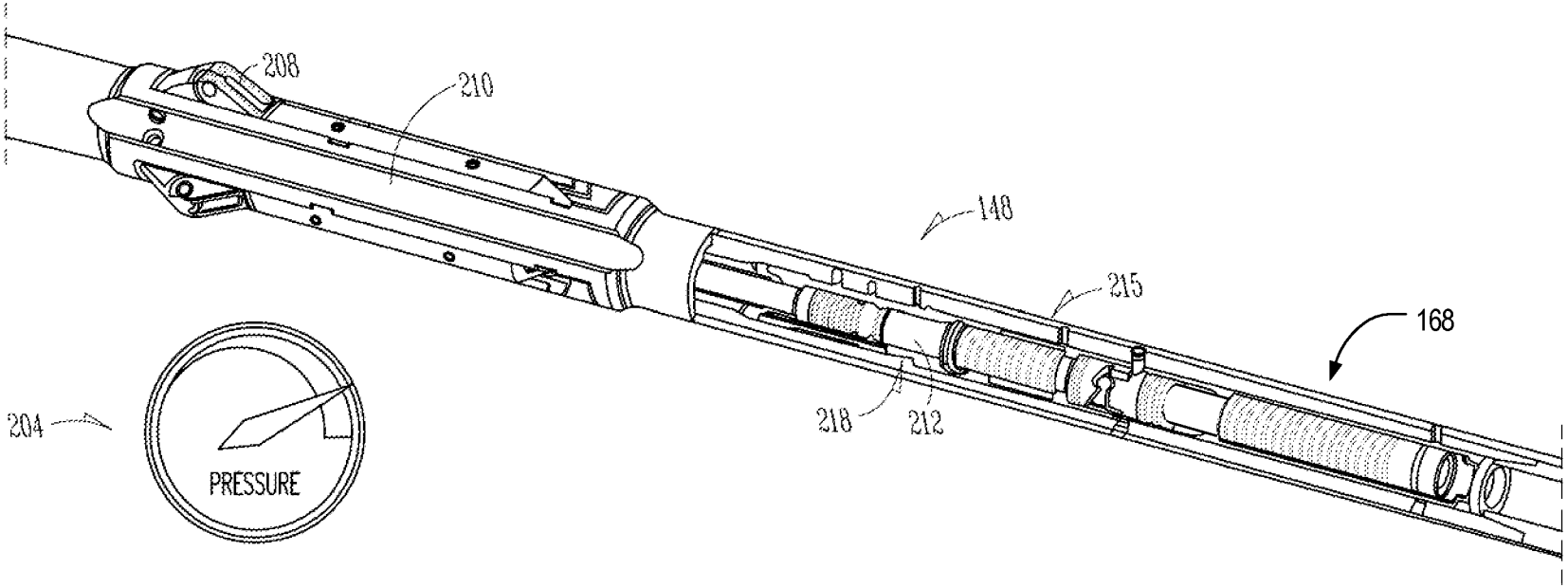

Compare this to FIG. 2B, which shows the reamer assembly 118 in the activated mode. In FIG. 2B, the bore pressure is again at operational levels, but now the reamer 144 is in a deployed condition in which the reamer arms 208 are radially extended, standing proud of the reamer body 210 and projecting radially outwards from the reamer body 210 to make contact with the borehole wall for reaming of the borehole 104 when the reamer body 210 rotates with the drill string 108. In this example, the reamer arms 208 are mounted on the reamer body 210 in axially aligned, hingedly connected pairs that jackknife into deployment, when actuated.

The difference in tool response to identical pressure conditions in the deactivated mode of FIG. 2A and the activated mode of FIG. 2B is due to the respective axial positions of a valve closure member in the example form of a valve piston 212 within a controller housing 215 having a generally tubular wall 423 (FIG. 4). The controller 148 provides a valve port 218 to place the bore 128 in fluid flow communication with the reamer assembly 118. Exposure of the reamer assembly 118 to operational bore pressures, via the valve port 218, causes hydraulic actuation of the reamer arms 208 towards their deployed position. In the deactivated mode (FIG. 2A) the valve piston 212 is locked to stay in a range of axial positions in which it closes the valve port 218, thus isolating the reamer assembly 118 from bore pressure and rendering it unresponsive to high bore pressure values.

In the activated mode, however, the valve piston 212 is axially spaced from its position in the deactivated mode, in this example being positioned further downhole in the controller housing 215, so that the valve piston 212 is clear of the valve port 218, exposing the reamer assembly 118 to bore pressure fluctuations and allowing automatic reamer deployment responsive to operational fluid pressure in the bore 128.

The controller 148 further includes a locking mechanism 168 (also referred to herein as a stay mechanism) for locking the controller 148 in the respective modes, to prevent inadvertent activation/deactivation. The locking mechanism 168 is configured to lock the controller 148 in the deactivated mode by preventing or staying movement of the valve piston 212 far enough downhole to open the valve port 218, and to lock the controller 148 in the activated mode by preventing unlatching of the valve piston 212 from a latch mechanism that keeps the valve piston from returning to its deactivated mode position. As will be described in further detail below, the locking mechanism 168 prevents unlatching of the valve piston 212 by again stopping the valve piston 212 from moving far axially far enough to escape the latch mechanism.

The locking mechanism 168 is configured to allow mode switching (comprising axial displacement of the valve piston 212 from its deactivated mode position to its activated mode position, and vice versa), by application of a trigger pressure condition that, in this example, includes application of a pressure differential lower than a pre-defined trigger threshold value (in this example being about 20 bar) for at least a trigger threshold interval (in this example being about 15 minutes). Higher threshold intervals may reduce inadvertent activation risks, but some operators may prefer shorter threshold intervals, and these intervals may thus be varied depending on drilling conditions and/or user preference. In some embodiments, the trigger threshold interval may be about one minute.

Various hydro-mechanical aspects and features of the controller 148 will now be described, but note that the axial position of the valve piston 212, in this example embodiment, determines the operational mode of the reamer system provided by the reamer assembly 118 and controller 148. The mechanisms and components described hereafter cooperate to facilitate axial positioning of the valve piston 212 as desired by remote pressure-sequence control from the surface control system 140.

Some components and mechanisms of the controller 148 that contribute to such pressure-controlled reamer deployment will now briefly be mentioned in a high-level overview, after which these features are described at greater length in the context of this example embodiment. Thereafter, functional interaction of the example controller components is discussed.

High-Level Functional Overview

Figure 3A:
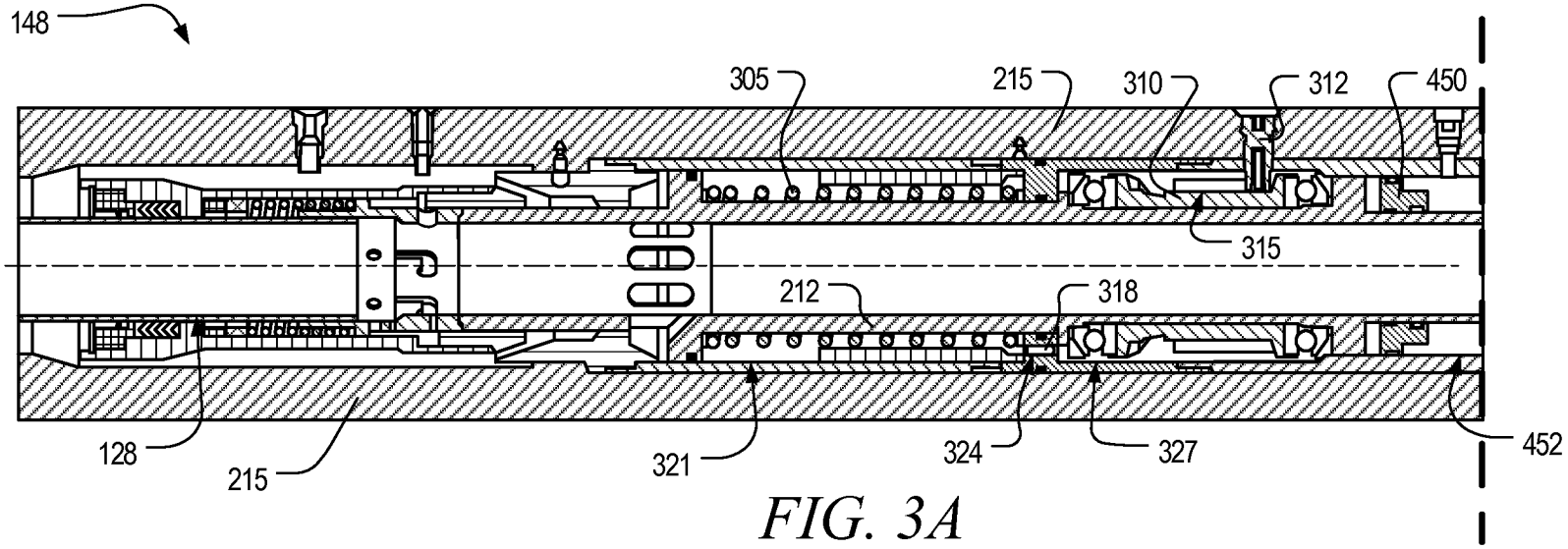
FIGS. 3A-3B depict a longitudinal section of the drilling apparatus of FIG. 2, according to an example embodiment.

Various components acting directly and/or indirectly on the valve piston 212 to dispose it in either its dormant-mode position or its active-mode position can be seen in FIG. 3. The valve piston 212 is urged towards its dormant-mode position by a valve-closing bias arrangement in the example form of a closing spring 305 that acts between the controller housing 215 and the valve piston 212 to urge the valve piston 212 axially uphole, i.e. towards the left-hand side in FIG. 3. In the absence of hydraulic forces acting on the valve piston 212, the closing spring 305 would thus move the valve piston 212 uphole into a position where the valve port 218 is closed by a part of the valve piston 212 that acts as a valve closure member (see, e.g., valve closure sleeve 409 in FIG. 4). For clarity of illustration, the valve piston 212 is shown in the drawings to be of one-piece construction, but it may be comprised of two or more generally tubular members that are screwed together end-to-end, to facilitate assembly.

In the deactivated mode, the valve piston 212 is free to move into its closed position under the urging of the closing spring 305, absent fluid pressure. In the activated mode, however, axial movement of the valve piston 212 towards the uphole end of the controller housing 215 (to close the valve port 218) is limited by the latch mechanism. The latch mechanism in this example comprises a barrel cam 310 (which is axially anchored to the valve piston 212 but is free to rotate about it) and a cooperating cam follower in the form of a latch pin 312 mounted on the controller housing 215. As will be described at greater length, the barrel cam 310 has a recessed track 315 that is followed by the latch pin 312. The track 315 includes a latch slot 512 (FIG. 5) in which axial uphole movement of the valve piston 212 (to close the valve port 218) is stopped short of its valve-closing position by abutment of the latch pin 312 against a stopping end of the track 315's latch slot 512. Switching to the activated mode in this example thus comprises entry of the latch pin 312 into the latch slot 512 of the track 315 of the barrel cam 310, while switching to the deactivated mode comprises escape of the latch pin 312 from the latch slot 512.

The valve piston 212 can move axially downhole within the controller housing 215, against the bias of the closing spring 305, when fluid pressure in the bore 128 is at operational levels ("high pressure/flow") or at a sub-operational levels ("low pressure/flow"). The speed of axial movement of the valve piston 212 against the closing spring 305 is limited by an opening speed control mechanism or retarding arrangement comprising a flow restrictor 318 that limits a rate of hydraulic flow through a flow control channel 324 from a control fluid reservoir 321 to a draw chamber 327. In this example, the flow restrictor 318 is a Lee Flosert that controls the rate at which oil can move through the flow control channel 324 from the control fluid reservoir 321 to the draw chamber 327 when there is a differential pressure across it. The effective flow rate through the flow restrictor 318 may thus be substantially constant for a range of pressure differences. Hence, the flow restrictor 318 controls the speed of movement of the valve piston 212, allowing accurate calculation of a trigger threshold interval for which the valve piston 212 is to move under hydraulic actuation in order to switch operational modes of the controller 148. The flow restrictor 318 may allow substantially unrestricted fluid movement in the opposite direction. In some embodiments, fluid return from the draw chamber 327 to the control fluid reservoir 321 may be achieved or facilitated by provision of a valve arrangement between the relevant chambers. For example, check valves or unidirectional valves are in some embodiments mounted in a dedicated fluid passage between the chambers 321, 327, being oriented to allow substantially unrestricted flow through the fluid passage in a direction opposite to the direction in which the flow restrictor 318 governs valve piston speed.

Axial movement of the valve piston 212 downhole can be blocked by the locking mechanism 168 (See, FIGS. 3B and 7), which in this example embodiment is located downhole of the barrel cam 310. In this example, the locking mechanism 168 comprises a stay member in the example form of a generally tubular lock piston 331 that is co-axial with the valve piston 212 and is axially displaceable in the controller housing 215, to allow relative movement of the lock piston 331 to both the controller housing 215 and the valve piston 212. The valve piston 212 and the lock piston 331 are arranged end-to-end, with their adjacent ends overlapping telescopically in an overlap portion of the locking mechanism 168. A downhole end portion 352 of the valve piston 212 is thus in this example telescopically received with sliding clearance in an uphole end portion 354 of the lock piston 331.

The locking mechanism 168 further includes a plurality of obstruction elements in the example form of a circumferentially spaced ring of locking balls 356 (only one of which is visible in the sectional view of FIG. 3B-7), each of which is held captive by the lock piston 331 and its end portion 354, therefore overlapping the valve piston end portion 354. Each locking ball 356 is located in a complementary caging hole 358 (see FIG. 7) extending through the tubular wall of lock piston 331, so that the locking ball 356 bears against and follows the radially outer periphery of the valve piston end portion 352. The locking ball 356 is this radially displaceable relative to the lock piston 331, while being axially secured to the lock piston 331 for movement therewith.

For ease of description, further discussion of the locking mechanism 168 mainly refers to the behavior of the locking balls 356 in the singular, but it should be remembered that the locking mechanism 168 in this example embodiment includes a number of circumferentially spaced balls 356 whose behavior is substantially identical. Other embodiments, however, can have a single roller or locking ball 356 to serve as locking element between the valve piston 212 and the lock piston 331.

The locking mechanism 168 in this example embodiment operates by selectively causing interference between the valve piston 212 and the locking ball 356. The locking mechanism 168 can thus be switched between an unlocked condition (in which the telescopically received end portion 352 of the valve piston 212 is free to move axially past the locking ball 356) and a locked condition (in which axial downhole movement of the valve piston 212 is stopped by obstruction against the locking ball 356. Whether the locking mechanism 168 is in the unlocked condition or the locked condition depends on the particular axial position of the lock piston 331 within the controller housing 215.

The overlap portion of the valve piston 212 and the lock piston 331, is located in a lock sleeve 360 mounted co-axially within the controller housing 215 and secured against axial movement relative to the controller housing 215. A radially inner periphery of the lock sleeve 360 defines a chamber wall that is radially spaced from the radially outer periphery of the valve piston end portion 352, so that a more or less annular locking chamber 362 is defined between the valve piston end portion 352 and the lock sleeve 360. The radially inner periphery of the lock sleeve 360 is radially stepped, narrowing at a step or constriction 366 where the inner diameter of the locking chamber wall changes are. The locking chamber 362 thus has a narrower constricted portion 368 (here, located downhole of the constriction 366) and a wider release portion 370 (here, located uphole of the constriction 366). Note that the constriction 366 is shaped to guide the locking ball 356 radially inwards into the constricted portion 368 in response to axial movement of the ball across the constriction during downhole axial actuation of the locking piston 331.

Figure 3B:
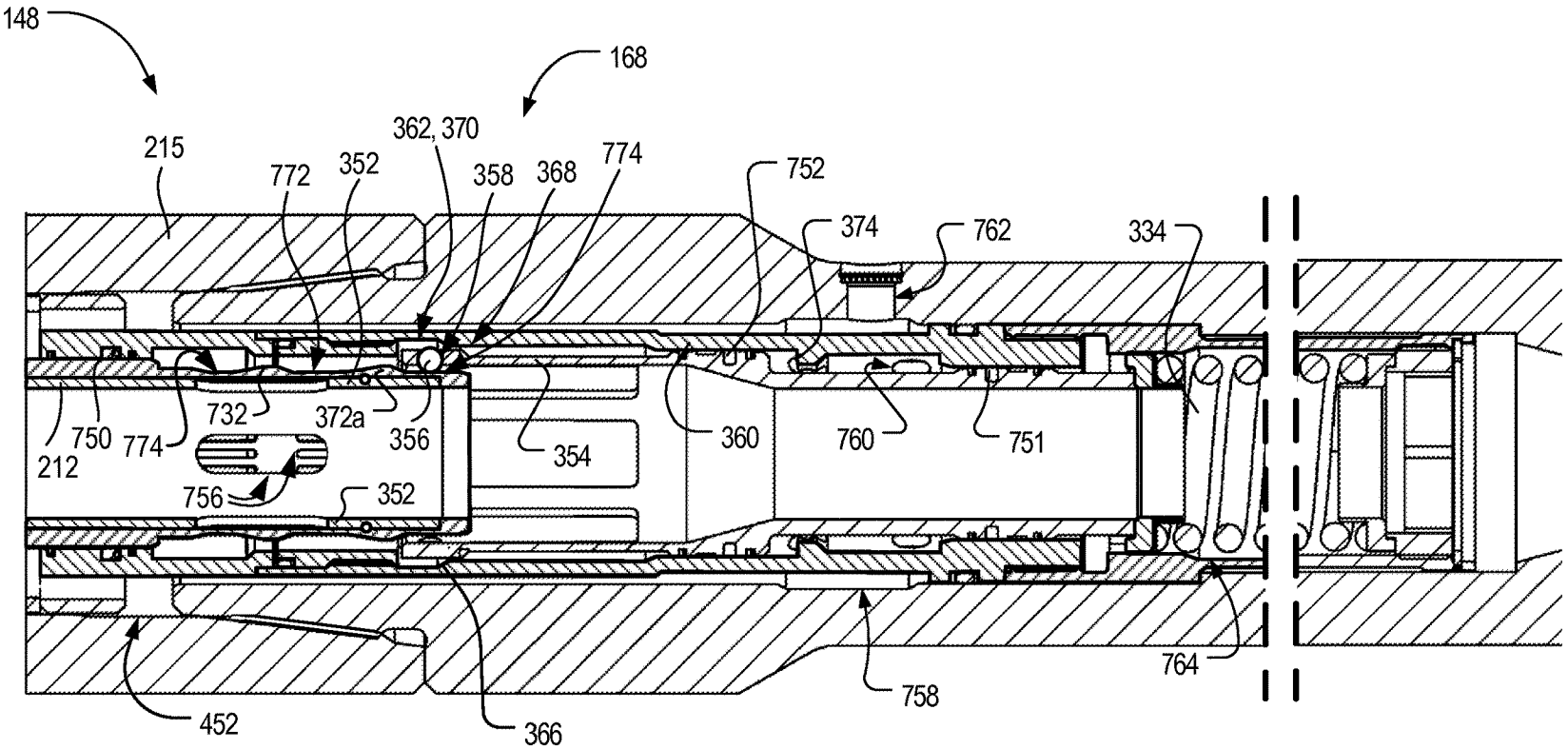

The valve piston end portion 352 carries a pair of interference formations for obstructing against the locking ball 356 when it (the locking ball 356) is located in the constricted portion 368. In this example, the interference formations comprise a pair of axially spaced, radially projecting annular protrusions that define wedge-like ridges or humps 372 that reduce the radial clearance between the valve piston 212 and the lock sleeve 360, such that the humps 372 can move past the locking ball 356 when it is in a clearing position (here, when the locking ball 356 it is in the release portion 370 of the locking chamber 362, as shown in FIG. 3B), but such that movement of either of the humps 372 past the locking ball 356 is physically obstructed when the locking ball 356 is in the constricted portion 368—thereby stopping further movement axially downhole of the valve piston 212.

When the locking ball 356 is in its obstructing position (where the locking ball 356 has been moved under hydraulic actuation of the lock piston 331 past the constriction 366 and into the constricted portion 368), further hydraulically actuated advance of the lock piston 331 against the lock spring 334 is prevented by obstruction of an annular collar of the lock piston 331 against a complementary stopping shoulder 374 forming part of the lock sleeve 360. When the valve piston 212 is stopped by obstruction against the locking ball 356, any axially acting forces exerted on the lock piston 331 by the valve piston 212, via the ball 356, is resisted by the stopping shoulder 374.

The locking ball 356 is movable from the release portion 370 to the constricted portion 368, and vice versa, by axial movement of the lock piston 331 relative to the controller housing 215. The valve piston 212 is urged axially uphole by a lock spring 334 to the clearing position (FIG. 3B) in which the locking ball 356 is located in the release portion 370 of the locking chamber 362 and is thus clear of interference with the valve piston 212. The locking mechanism 168 is configured such that at high, operational mud pressure and/or flow, the lock piston 331 moves axially downhole, against the bias of the lock spring 334 (in the same axial direction as that of the valve piston 212 under hydraulic drilling fluid actuation, in this example referred to as the opening direction), to move the locking ball 356 into the constricted portion 368 of the locking chamber 362, stopping movement of the valve piston 212 axially downhole.

Due in part to operation of the flow restrictor 318, provision of bore pressures sufficient for actuated movement of the lock piston 331 against the lock spring 334 causes the lock piston 331 to move axially downhole faster than the valve piston 212 moves downhole, moving the locking ball 356 into its locking position in the constricted portion 368 of the locking chamber 362 before a downhole adjacent one of the humps 372 reaches the constriction 366, thus stopping the valve piston 212 before the latch pin 312 can escape or enter the latch slot 512 of the barrel cam 310, as the case may be. Thus, in the deactivated mode, the lock piston 331 is moved into the locking position to block the valve piston 212 from advancing far enough downhole to clear the valve port 218 or allow the latch pin 312 to enter the latch slot 512 in the barrel cam 310. In the activated mode fluid-pressure actuated downhole movement of the lock piston 331 likewise blocks the valve piston 212 from advancing far enough downhole to reach an unlatching position in which it would exit the latch slot in the barrel cam 310, thus keeping the valve piston 212 latched in an axial range in which the valve port 218 is open.

These pistons and springs are, however, dimensioned and configured such that, at a sub-operational pressure lower than a threshold level (also referred to herein as a trigger pressure), the valve piston 212 is actuated to move axially downhole, overcoming elastic resistance of the closing spring 305, but hydraulic actuation forces on the lock piston 331 are not sufficient to overcome the lock spring 334. As a result, application of such a sub-operational or sub-threshold pressure for a period longer than a trigger interval causes axial downhole movement of the valve piston 212 (without obstruction by the locking ball 356, which is kept in the release portion 370 of the locking chamber 362 by the now substantially stationary lock piston 331) far enough to allow entry of the latch pin 312 into the latch slot 512 (thus switching from the deactivated mode to the activated mode) or the allow the latch pin 312 to escape the latch slot (thus switching from the activated mode to the deactivated mode), as the case may be.

The controller components mentioned briefly above will now be described separately in more detail, whereafter cooperative behavior of the components of the example controller 148, in practice, are discussed.

Valve Piston Features

Figure 4A:
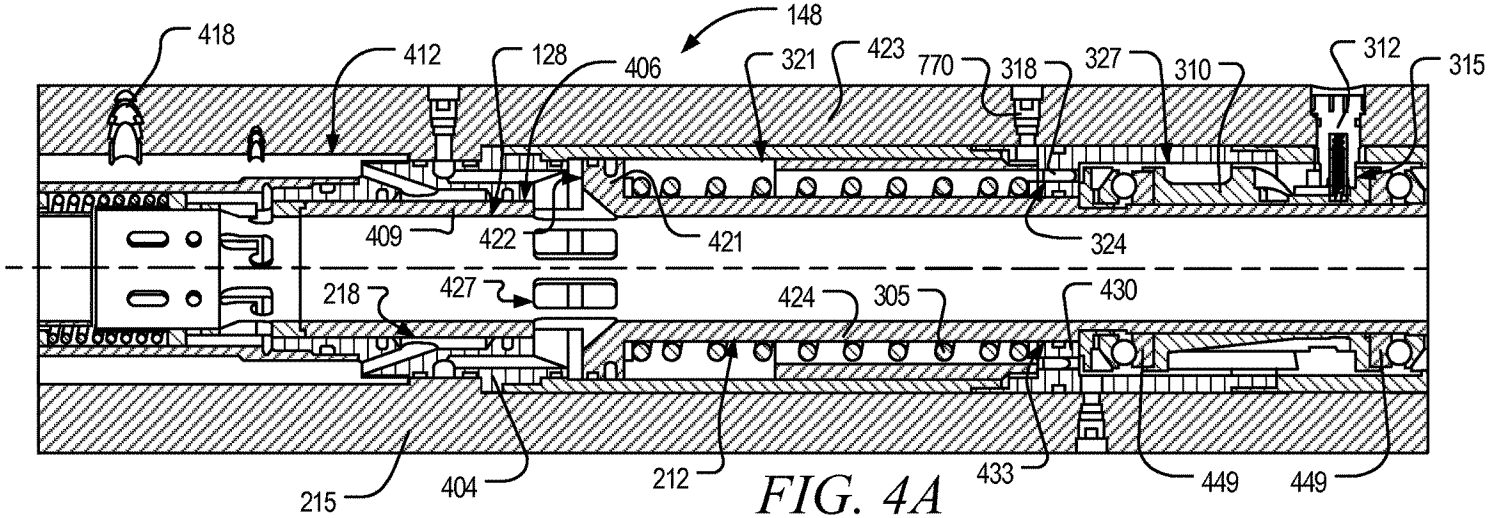
FIGS. 4A-4B depicts a longitudinal section of a part of the drilling apparatus of FIG. 2, on an enlarged scale, showing a valve piston of the drilling apparatus in a closed condition and in an open condition respectively.
Figure 4B:
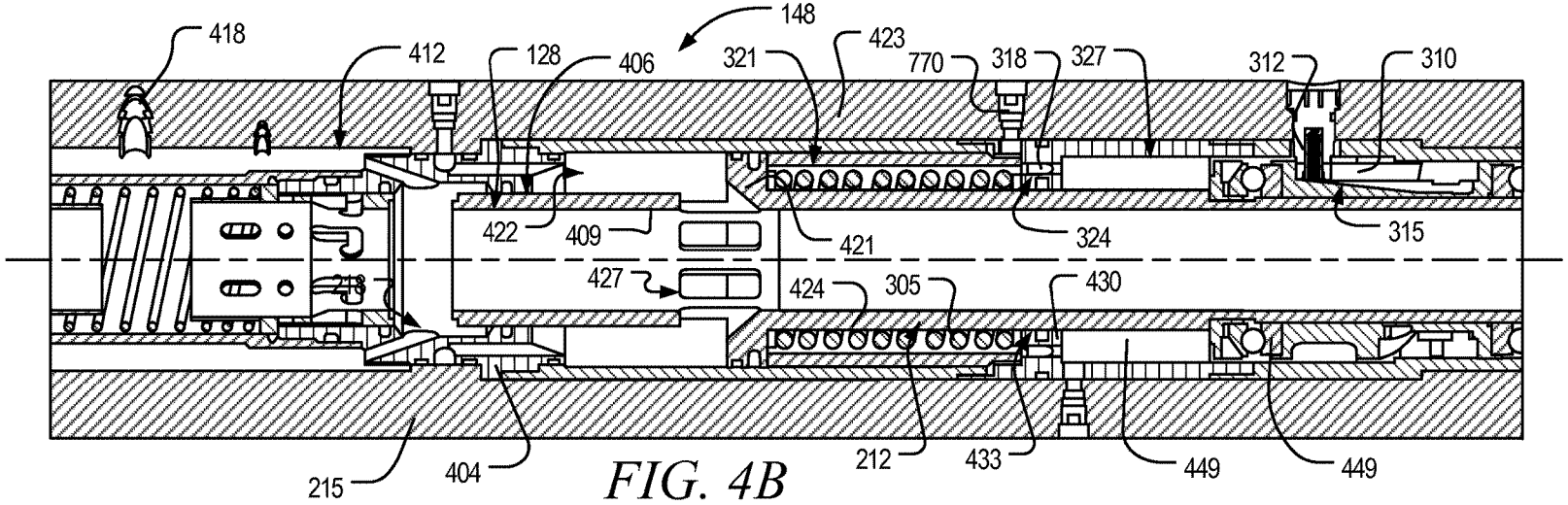

FIGS. 4A and 4B show views of the example controller 148 in the dormant and activated modes respectively, in which some additional features of the example valve piston 212 are visible. A valve port insert 404 is, in this example, mounted co-axially in the controller housing 215, defining a bore opening 406 in which a co-axial valve closure sleeve 409 provided by an uphole end portion of the valve piston 212 is sealingly received. The valve port insert 404 is anchored to the controller housing 215, with the valve closure sleeve 409 being axially slidable through the bore opening 406.

The valve port insert 404 defines the valve port 218 in the example form of a fluid flow channel that places a portion of the drill-string's bore 128 defined by the valve port insert 404 in communication with a substantially annular reamer actuation chamber 412. In its deactivated mode position (FIG. 4A), the valve closure sleeve 409 closes the valve port 218, isolating the reamer actuation chamber 412 from the bore 128. When displaced axially downhole to its active-mode position (FIG. 4B), the uphole end of the valve piston 212 is clear of the valve port 218, so that the reamer actuation chamber 412 is in fluid flow communication with the bore 128 via the valve port 218, exposing the reamer actuation chamber 412 and therefore the reamer assembly 118 to bore pressure. The housing 215 includes one or more nozzles 418 to flush cuttings from the housing 215. Fluid ejection from the nozzles 418 may also serve as a surface pressure indicator to indicate tool activation to operators at the surface. A relief valve (not shown) is provided between chamber 412 and the bore 128, serving as a failsafe measure in case the valve piston 212 the associated nozzles are clogged, trapping pressure below the drive piston. In such a case, the reamer arms can be forced down by pulling against a restriction hard enough to overcome the relief valve. Instead, or in addition, a relief valve may be provided between the chamber 412 and the annulus 134.

To the downhole side of the bore opening 406, the valve piston 212 has a radially projecting, circumferentially extending annular uphole collar or shoulder 421 that has a radially outer end edge in sealing, sliding engagement with an inner cylindrical surface of the controller housing 215's tubular wall 423. The valve piston 212 is thus co-axially slidable within the controller housing 215.

An annular space between a tubular central portion 424 of the valve piston 212 and the tubular wall 423 of the controller housing 215 provides, to a downhole side of the uphole shoulder 421, the control fluid reservoir 321. The valve piston 212 has a circumferentially extending series of mud flow openings 427 positioned uphole of the shoulder 421, thus allowing fluid transfer between the bore 128 and an annular space extending radially between the cylindrical outer surface of the valve piston 212 and the tubular wall 423 of the controller housing 215, uphole of the uphole shoulder 421. Because fluid pressure in the control fluid reservoir 321 substantially matches annulus pressure (through operation of pressure balance mechanisms that will be discussed shortly), a pressure differential over the uphole shoulder 421 is substantial equal to the bore-annulus pressure differential. Typically, the higher of these pressures is on the uphole side of the uphole shoulder 421 (i.e., bore pressure), so that a net hydraulic force is exerted on the valve piston 212 in the downhole direction.

The controller housing 215 provides an annular chamber wall 430 that projects radially inwards from the controller housing's (215) tubular wall 423 at a position spaced downhole from the bore opening 406, axially beyond the uphole shoulder 421. The chamber wall 430 defines a cylindrical bore aperture 433 in which the valve piston 212 is slidingly received, a radially outer cylindrical surface of the valve piston 212 being in sealing engagement with a complementary mating radially inner edge surface of the chamber wall 430. The chamber wall 430 thus sealingly bounds the control fluid reservoir 321 at an uphole end thereof. The chamber wall 430 is anchored against axial movement relative to controller housing 215. As a result, axial displacement of the valve piston 212 in the controller housing 215 changes the volume of the control fluid reservoir 321. The closing spring 305 is located in the control fluid reservoir 321, being positioned co-axially about the central portion 424 of the valve piston 212 and acting between the uphole shoulder 421 and the chamber wall 430.

The draw chamber 327 is bounded at its downhole end by a floating annular balance piston 450 (see FIG. 3A) that is in sealing sliding engagement with both the radially outer surface of the valve piston 212 and a radially inner surface of the housing wall 423 (or a lining provided on the wall 423). The balance piston 450 thus seals the draw chamber 327 at its downhole end. The balance piston 450 is located on the far side of the barrel cam 310 from the chamber wall 430, so that the barrel cam 310 is housed in the draw chamber 327. The draw chamber 327 is thus a substantially annular space defined radially between the valve piston 212 and the wall 423 (or its lining), and axially between the chamber wall 430 and the balance piston 450. As mentioned, the draw chamber 327 is in fluid flow communication with the control fluid reservoir 321 via the flow control channel 324, in which the flow restrictor 318 is mounted. Note that the draw chamber 327 is variable in volume by axial movement of the balance piston 450, which automatically floats axially to find an equilibrium position in which there is substantially no pressure differential across it.

A substantially annular volume around the valve piston 212 and immediately downhole of the balance piston provides a compensation chamber 452 which is isolated from the bore 128, and which is in fluid communication with the annulus via a fluid passage 762 extending through the housing wall 423 (see FIG. 3B). The compensation chamber 452 is thus maintained at annular pressure, with the balance piston 450 automatically and dynamically moving to allow expansion of the draw chamber 327, while keeping both the compensation chamber 452 and the draw chamber 327 substantially at annulus pressure.

Barrel Cam Features

As mentioned, the controller 148 according to this example embodiment includes a barrel cam 310 that is mounted co-axially in the valve piston 212. In the embodiment illustrated in FIG. 4, the barrel cam 310 is anchored to the valve piston 212 for axial movement therewith by being sandwiched by two axially spaced ball bearings 449 (FIG. 4) that are mounted for axial movement with the valve piston 212. By operation of the bearings 449, the barrel cam 310 is free to rotate relative to the valve piston 212 about the longitudinal axis.

Figure 5A:
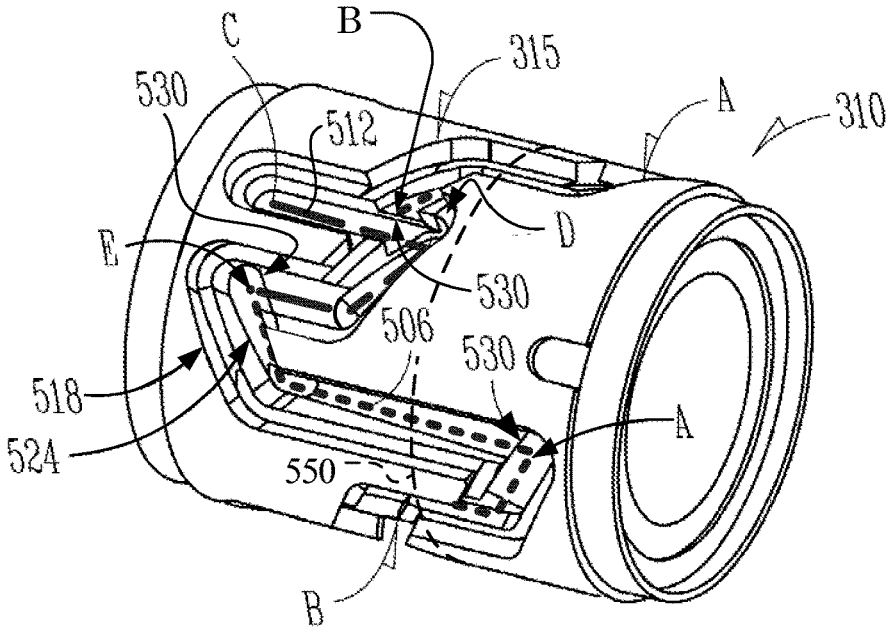
FIGS. 5A and 5B depict three-dimensional views of a barrel cam to form part of a drilling apparatus of FIG. 2, according to an example embodiment.
Figure 5B:
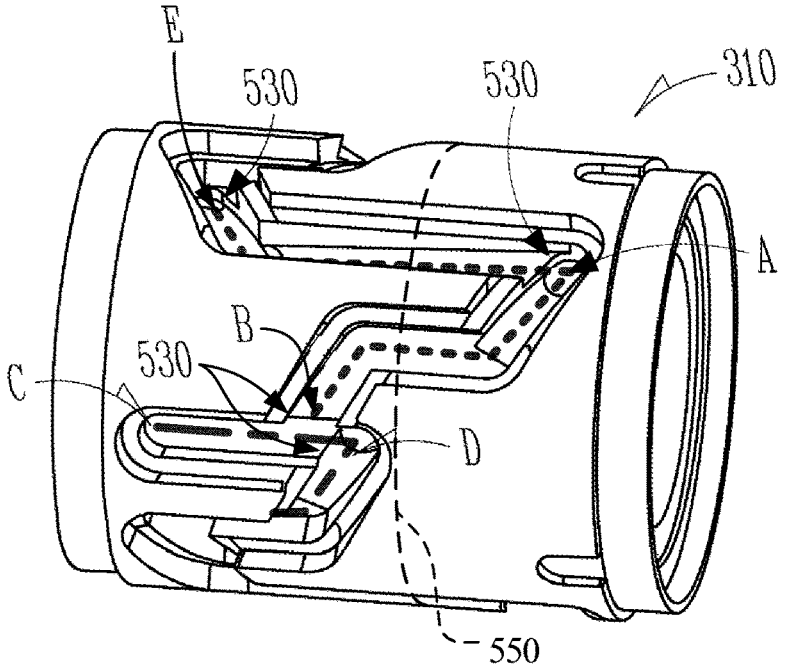
Figure 6:
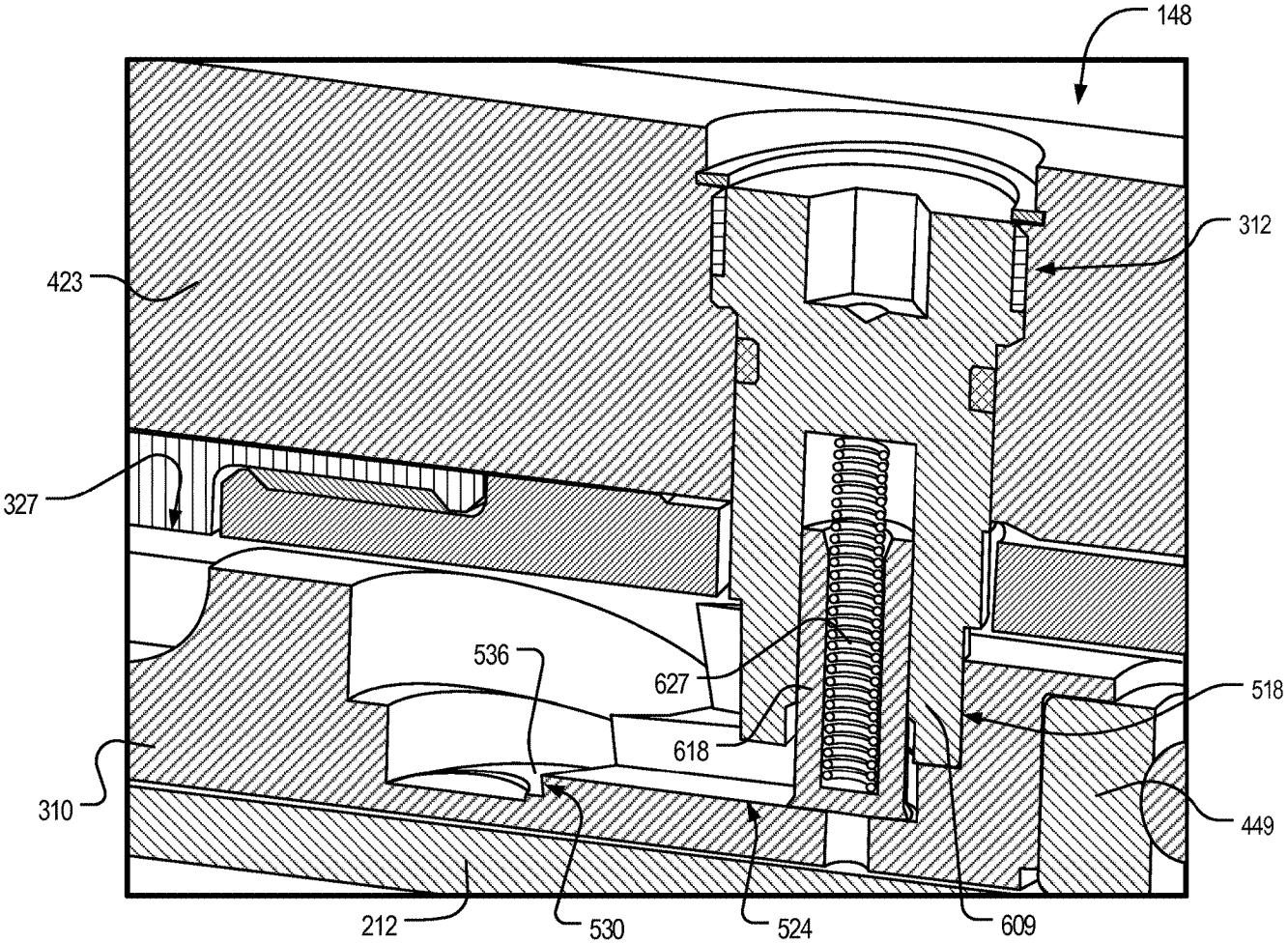
FIG. 6 depicts a longitudinally sectioned three-dimensional view of part of the drilling apparatus of FIG. 2, on an enlarged scale, showing details of a latch pin and barrel cam forming part of the drilling apparatus according to an example embodiment.

Turning now to FIGS. 5 and 6, it can be seen that a radially outer cylindrical surface of the example barrel cam 310 defines the track 315 that cooperates with the latch pin 312 in a cam/follower arrangement. The track 315 comprises an endless guide recess 518 that has a substantially even depth, extending circumferentially around the barrel cam 310, but varying in axial positions that can be occupied by the latch pin 312. The track 315 further comprises a floor channel 524 (also referred to as a locking channel) having a path identical to that of the guide recess 518, but having a smaller width and a greater depth. Described differently, the floor channel 524 is an elongate slot-like cavity centered in the guide recess 518.

The latch pin 312 in this example comprises a follower pin 609 that is mounted in the tubular wall 423 of the controller housing 215 and projecting radially inwards into the guide recess 518 with sliding clearance, to bear against sidewalls of the guide recess 518 for translating axial movement of the valve piston 212 to rotational movement of the barrel cam 310. The latch pin 312 further comprises a catch pin 618 housed co-axially in a blind socket in the follower pin 609. The catch pin 618 is telescopically slidable relative to the follower pin 609, projecting radially inwards from the radially inner end of the follower pin 609. The catch pin 618 is spring-loaded, being urged by a latch spring 627 away from the follower pin 609 to bear against a floor of the floor channel 524.

Unlike the guide recess 518, the floor channel 524 varies in depth along its length. Such depth variations include sudden depth changes at a number of latch steps 530, and gradual depth changes at which the floor of the floor channel 524 are inclined to form ramps 536 that act as cam surfaces that causes radial raising or lowering of the catch pin 618 when the follower pin 609 moves along the track 315.

In FIG. 5A, a portion of the track 315 within which the latch pin 312 may be held captive to latch the controller 148 in the activated mode (referred to herein as a latch slot) is generally indicated by chain-dotted line 512. Those portions of the track 315 corresponding to the deactivated mode (referred to herein as an unlatch slot) are indicated in FIG. 5 by dotted line 506. Note that, in this example embodiment, disposal of the controller 148 in either the activated mode or the deactivated mode is distinct from opening or closing the valve port 218. In FIGS. 5A and 5B, broken line 550 schematically represents an axial position for the valve piston 212 at which the valve piston 212 opens or closes the valve port 218. Thus, the valve port 218 is open when line 550 on the barrel cam 310 is in this example located downhole of the latch pin 312 (i.e., when the latch pin 312 is to the left of line 550, in the orientation of FIG. 5). Likewise, the valve port 218 is closed when line 550 on the barrel cam 310 is in this example located uphole of the latch pin 312 (i.e., when the latch pin 312 is to the right of line 550, in the orientation of FIG. 5).

Note that an extreme downhole point of the unlatch slot 506 (point A) is located such that the valve piston 212 closes the valve port 218 when the latch pin 312 is at point A. When the latch pin 312 is at point A, it cannot move along the unlatch slot 506 to point E due to a step 530 on which the catch pin 618 fouls. Instead, downhole movement of the valve piston 212 causes movement of the barrel cam 310 such that the latch pin 312 moves along the unlatch slot 506 from point A towards point B. Portion AB of the unlatch slot 506 defines a ramp 536 that pushes the catch pin 618 radially outwards.

Note also that point B is to the left of line 550 (see FIG. 5B), so that the valve port 218 is opened before the latch pin 312 enters the latch slot 512 at point B. If hydraulic actuation of the valve piston 212 ceases before the latch pin 312 reaches point B, the barrel cam 310 will automatically move uphole, so that the latch pin 312 travels back to point A, again crossing line 550. In such a case, the valve port 218 will have been opened temporarily, and then closed again, without changing mode of the controller 148.

If the latch pin 312 passes point B, it enters the latch slot 512 and cannot return to leg AB due to the step 530 at point B. The latch slot 512 has an extreme downhole position (point D) that is significantly short of point A, corresponding to a valve piston 212 position in which the valve port 218 is open. The latch slot 512 in this example comprises two portions (leg C-D and leg D-E), separated by a step 530 at point D. The floor of the floor channel 524 is inclined to provide ramps 536 from point C to point D, and from point D to point E. Another step 530 at point E prevents reentry of the latch pin 312 into the latch slot 512 once it has escaped the latch slot 512 by reaching point E, having then entered the unlatch slot 506 and being movable axially along the unlatch slot 506 from point E to point A.

Note that one cycle of the track 315 (e.g., from point A to point A) in this example embodiment comprises only one third of the circumference of the barrel cam 310. The described cycle thus repeats, in this example, thrice for one revolution of the barrel cam 310, and the barrel cam 310 cooperates with three latch pins 312 at 120 degree intervals. See in this regard, e.g., FIGS. 8A-8G, in which the wall 423 is angularly sectioned to reveal two of the latch pins 312.

Lock Piston Features

Figure 7:
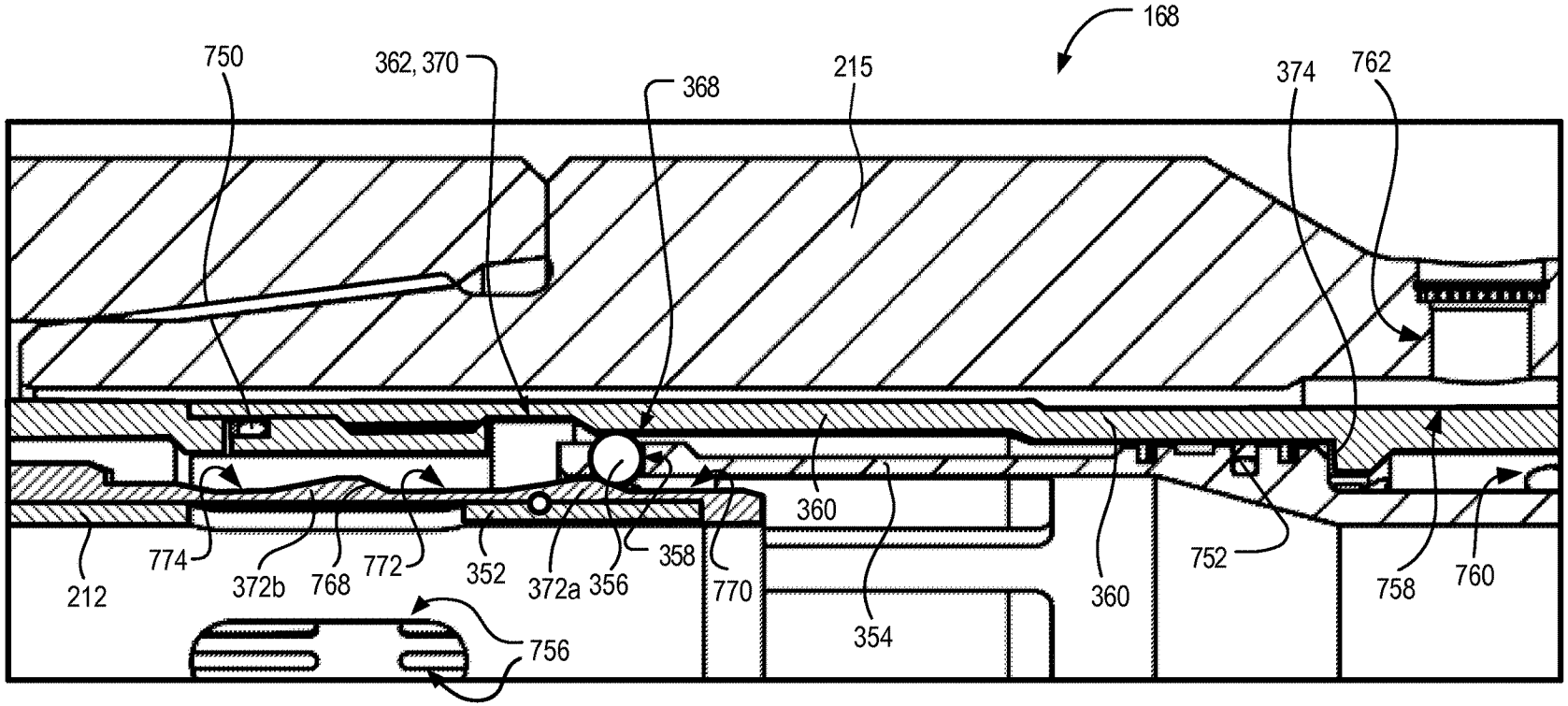
FIG. 7 depicts a schematic longitudinal section of a part of the drilling apparatus of FIG. 2, on an enlarged scale, showing details of a locking mechanism comprising a stay piston or lock piston of the drilling apparatus according to an example embodiment.

An overview of the construction and functionality of the locking mechanism 168 was described with reference to FIG. 3B. Additional features of the example of the locking mechanism 168 will now be discussed at the hand of FIG. 3B and FIG. 7, which shows an enlarged view of the overlapping piston end portions 352, 354 and the locking chamber 362. Note that, in FIG. 3B, the illustrated state of the controller 148 is that the lock piston 331 is in the unlocked position, the valve piston 212 is unlatched, and there is little or substantially no bore-annulus pressure differential. FIG. 7, shows the state of the locking mechanism 168 resulting from application of operational bore pressures when the controller 148 is in the state illustrated in FIG. 3B. As will be evident from what has gone before, the result of applying operational pressures when the controller 148 is in the dormant mode (also referred to in this example embodiment as the deactivated mode), as shown for example in FIG. 3B, is that the lock piston 331 moves into the obstructing position (where the locking ball 356 is located downhole of the constriction 366, in the constricted portion 368) and blocks downhole advance of the valve piston 212 by contact engagement with one of the humps 372.

The example lock piston 331 is a hollow cylindrical member that is co-axially located in the controller housing 215 within the lock sleeve 360 mounted in the controller housing 215, being a sealed sliding fit in the hollow cylindrical interior of the tubular lock sleeve 360. Similar to the valve piston 212, a cylindrical passage defined by the interior or the lock piston 331 is in-line with the bore 128 of the drill string 108, so that the passage defines the bore 128 for the portion thereof coinciding with the lock piston 331.

The lock sleeve 360 (which is in this example comprises an assembly of multipart construction) also receives the valve piston 212 co-axially at an uphole end of the locking mechanism 168. The valve piston 212 is a sliding, sealed fit in the lock sleeve 360, a sealing interface being defined between the outer diameter of the valve piston 212 and the lock sleeve 360 at a first seal 750 (FIG. 3B) adjacent the uphole end of the lock sleeve 360. The lock piston 331 also seals against the inner diameter of the lock sleeve 360, but at a second seal 752 located downhole beyond the constriction 366. The locking chamber 362 is thus defined between the first seal 750 and the second seal 752, with the cooperating locking parts that include the respective end portions of the lock piston 331 and the valve piston 212, the locking ball 356, the release portion 370 and the constricted portion 368, and the wedging humps 372 on the valve piston 212 being located within the locking chamber 362. The end portions 352, 354 of both the lock piston 331 and the valve piston 212 have radial flow openings 756 extending radially therethrough, to allow radial flow of drilling fluid from the bore 128 into the locking chamber 362. The locking chamber 362 is thus at bore pressure during operation.

The second seal 752 separates the interior of the locking mechanism portion of the controller 148 between the locking chamber 362 (located to its uphole side) and an exposure chamber 758 (located to downhole side). The lock sleeve 360 has, in a portion thereof corresponding to the exposure chamber 758, a series of radial flow holes 760 that extend through the tubular wall of the lock sleeve 360 to allow fluid flow therethrough. In addition, the tubular wall 423 of the controller housing 215 defines, in a portion thereof corresponding to the exposure chamber, a radially extending passage that provides an annulus opening 762. The annulus opening 762 places the exposure chamber 758 in fluid flow communication with the annulus 134, so that the exposure chamber 758 is in operation filled with drilling fluid (e.g., drilling mud), at fluid pressure values substantially equal to annulus pressure. A downhole end of the exposure chamber 758 is defined by a terminal seal 751 mounted on the outer diameter of the lock piston end portion 354 to seal against the inner diameter of the lock sleeve 360. The terminal seal 751 has a reduced diameter relative to the second seal 752.

The downhole end of the lock piston 331, furthest from the valve piston 212 is open to the hollow interior of the lock sleeve 360, which defines a spring chamber 764 providing a co-axial interior passage that defines the bore 128 of the drill string 108 for the corresponding portion of its length. The spring chamber 764 is thus, in operation, substantially at bore pressure.

Note that operational pressure differentials across the second seal 752 tend to urge the lock piston 331 downhole, while pressure differentials across the terminal seal 751 tend to urge the lock piston 331 in the opposite direction. The interior wall of the lock sleeve 360 is, however, reduced in diameter where it engages the second seal 752, so that the diameter of the downhole sealing interface provided by the terminal seal 751 is smaller than the corresponding diameter at the uphole interface provided by the second seal 752. Net hydraulic forces acting on the lock piston 331 in response to pressurized flow of drilling fluid along the bore 128 thus acts to urge the lock piston 331 downhole. Hydraulic actuation of the lock piston 331 is further assisted by a narrowing of its central passage in a nozzle adjacent the second seal 752.

As described previously, hydraulically actuated downhole movement of the lock piston 331 is resisted by the lock spring 334. The lock spring 334 is co-axially mounted in the spring chamber 764, being in co-axial, end-to-end engagement with a downhole end of the lock piston 331, urging it uphole towards the valve piston 212 (thus urging it, this example embodiment, in a closing direction of the valve piston 212). Note, again, that the properties of the spring are selected such that hydraulically actuated movement of the lock piston 331 is substantially prevented for pressure differentials lower than the predetermined trigger pressure, and to be sufficiently compressible responsive to above-threshold pressure conditions to allow hydraulically actuated axial downhole movement.

As shown in greater detail in FIG. 7, the Interference formations carried by the lock piston 331 in the example form of the pair of ridges or humps 372 that extend circumferentially around the lock piston end portion 354. As will be seen in FIG. 7, the lock piston end portion 354 is in this example embodiment of composite construction, an outer sleeve removably and replaceably mounted co-axially on the tubular wall of the lock piston end portion 354, with the humps 372 being defined by the radially outer surface of the replaceable sleeve. Such a construction allows the removable sleeve to serve as a wear sleeve which can be removed and replaced without having to retool the valve piston 221.

In this example embodiment, the humps 372 are substantially identical, each comprising a radial protrusion on the outer diameter of the lock piston 331, with sloping inclined surfaces on either side of a flattened apex. "Inclined" in this context means extending at an angle relative to the longitudinal axis. For ease of description, the downhole slope of each hump 372 is further referred to as the leading slope 768, while other inclined surface (located towards the uphole side of the apex) is referred to as the trailing slope. Each hump 372 is shaped to serve as a cam for causing radial movement of the locking ball 356 responsive to axial displacement of the locking ball 356 past the hump 372, or vice versa. The leading slope 768 is also to serve as an inclined contact surface or wedging surface that makes contact with the locking ball 356 when it is in the constricted portion 368 of the locking chamber 362 and is anchored against further downhole displacement. Axial stopping forces resulting that resist further downhole movement of the valve piston 212 is thus transferred from the lock piston 331 (due to its abutment against the shoulder 374) to the valve piston 212 via the locking ball 356.

The shape and profile of the humps 372 can vary from one embodiment to another, depending on design considerations and preferences. Each hump 372 may, for example, have a smoothly curved, or may have a more angular profile.

Note that the radial clearance between the apex of each hump 372 and the chamber wall provided by the lock sleeve 360 in the release portion 370 of the locking chamber 362 is greater than the diameter of the locking ball 356, while the radial clearance between the apex and the chamber wall 368 in the constricted portion 368 is smaller than the diameter of the locking ball 356. As a result, the locking ball 356 gets wedged between the lock sleeve 360 and the leading slope 768 of the respective hump 372 when movement of the hump 372 past the locking ball 356 in the constricted portion 368 is attempted.

Substantially circular cylindrical landings co-axial with the bore axis are defined by the radially outer periphery of the lock piston 331 on either side of and between the humps 372. For ease of description, these landings (which are here substantially flat in axial profile, as shown in FIG. 7) will further be distinguished as the front landing 770 (located downhole of the leading hump 372*a*, the rear landing 774 (located uphole of the trailing hump 372*b*), and the middle landing 772 (located between the leading hump 372*a* and the trailing hump 372*b*). Note that the axial spacing between the leading hump 372*a* and the trailing hump 372*b* is in this example embodiment substantially similar to the axial spacing between the latching and unlatching positions of the valve piston 212.

Each of the caging holes 358 is in this example embodiment a circular cylindrical passage extending radially through the tubular wall of the lock piston 331, its diameter being dimensioned such that the ball can pass radially through the caging hole 358. In this example, the locking ball 356 is a sliding fit in the caging hole 358. The diameter of the lock sleeve 360 in the release portion 370 is radially spaced from the outer diameter of the lock piston 331 by a distance smaller than the diameter of the locking ball 356. The locking ball 356 is thus prevented from radial escape from the caging hole 358 by the opposed surfaces of the valve piston 212 and the lock sleeve 360. Note that the circular cylindrical shape of the caging hole in this example embodiment causes the locking ball 356 to also be restrained against circumferential movement relative to the lock piston 331, thus maintaining a constant, regular spacing circumferentially between the plurality of locking balls 356.

Further features and methods of operation of the locking mechanism 168 will be evident from the following description, which describes example operation of one embodiment of the disclosure.

Example Controller Operation

An example sequence of operation of the controller 148 and the reamer assembly 118 is illustrated with reference to FIGS. 8A-8G. Each of these figures consists of a number of panels illustrating different aspects of the controller 114 and its operation at a particular stage of an example operation cycle. The various views of the valve piston 212, the barrel cam 310, and the locking mechanism 168 in a particular figure thus represent synchronous snapshots of the respective components at the stage of operation under discussion. Each one of FIGS. 8A-8G includes synchronized isolated views of, on the one hand, the valve piston 212 and the barrel cam 310, and, on the other hand, the locking mechanism 168, together with a pressure graph 807 and a latch travel diagram 820. The pressure graph 807 schematically shows bore-annulus pressure difference values over time.

Diagram 820 in FIGS. 8A-8G schematically indicates travel of the latch pin 312 along the track 315. Points A to E in diagram 820 corresponds to points A to E of the track 315 described with reference to FIG. 5. Pin position indicator 803 schematically indicates location of the latch pin 312 at point A in the unlatch slot 506. Dotted line 550 in each of the pin travel diagrams 820 indicates an axial position of the latch pin 312 relative to the barrel cam 310 at which the valve port 218 switches from being closed to being open (or vice versa) by the valve piston 212, thereby switching the reamer 144 from its retracted condition to its deployed condition (or vice versa). It will be understood from the preceding description that pin positions to the right of line 550 in the travel diagram 820 corresponds to valve piston positions in which the valve port 218 is closed, and that pin positions to the left line 550 in diagram 820 corresponds to positions of the valve piston 212 in which the valve port 218 is closed.

Figure 8A:
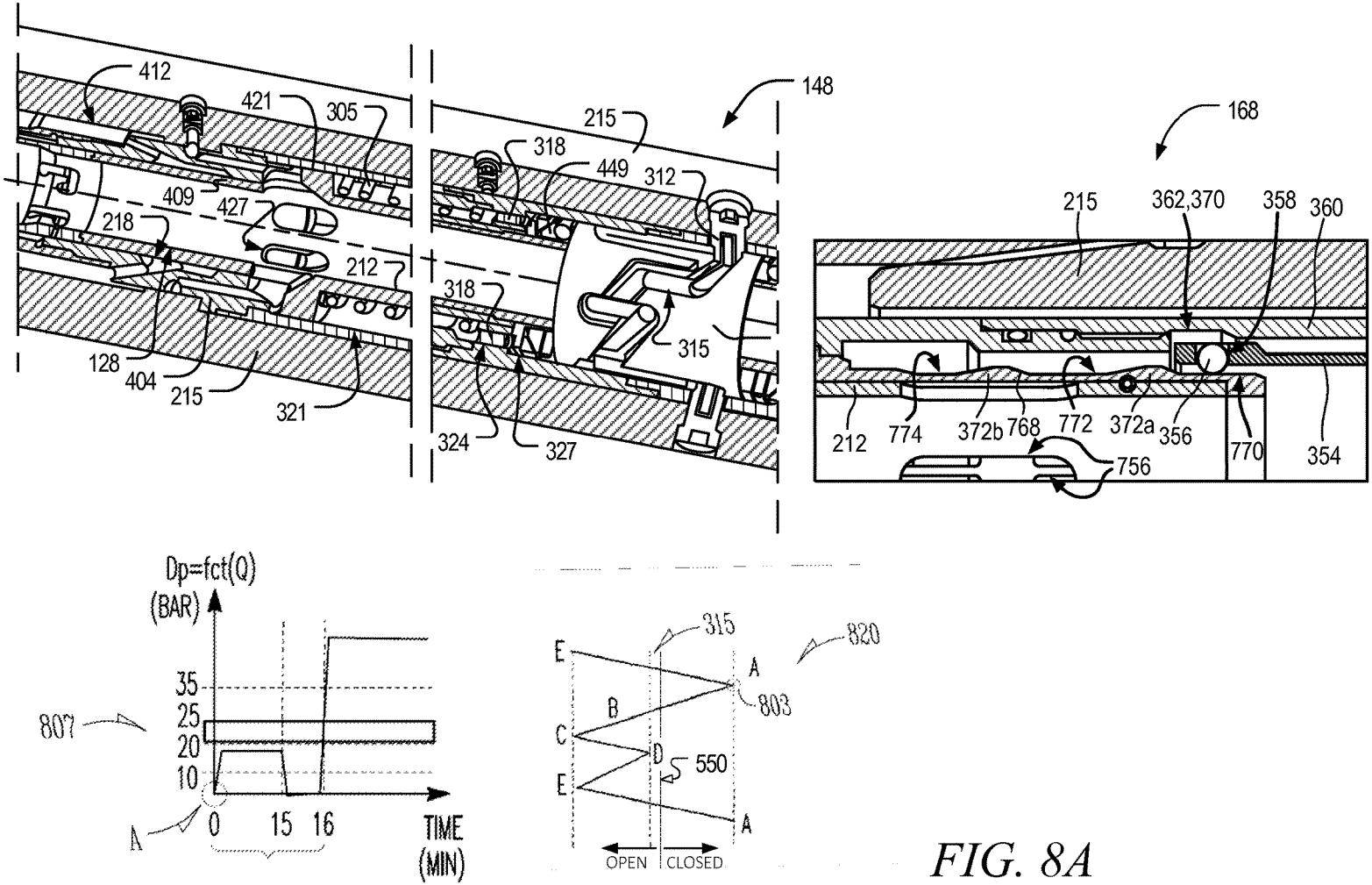
FIGS. 8A-8G each show a three dimensional longitudinal section of the drilling apparatus of FIG. 2 at various stages during controlled operation of the drilling apparatus, together with a pressure graph and a latch pin travel diagram corresponding to the condition of the associated longitudinal section, according to an example embodiment.

In FIG. 8A the controller 148 is shown initially to be in the deactivated mode. At first, drilling fluid in the bore 128 is not pressurized, so that the bore-annulus pressure difference is substantially zero (or is insufficient to overcome the effects of the springs 305, 331). In such a pumps-off situation, the valve piston 212 experiences substantially no hydraulic actuation, and is urged by the closing spring 305 uphole (i.e., leftwards in FIG. 8A). Being in the deactivated mode, the latch pin 312 is located in the unlatch slot 506 (FIG. 5). Due to operation of the closing spring 305, the latch pin 312 is located at point A, the valve piston 212 thus being at an extreme uphole position, in which the valve closure sleeve 409 closes the valve port 218.

The lock piston 331 is likewise urged to its extreme uphole position by the lock spring 334, so that the locking ball 356 is held captive by the lock piston end portion 354 in the release portion 370 of the locking chamber 362. The valve piston 212 is dimensioned such that the when the valve piston 212 is in the dormant, unlatched position shown in FIG. 8A, the front landing 770 of the valve piston end portion 352 is an axial register with the release portion 370 of the locking chamber 362. The locking ball 356 thus seats on the front landing 770, with radial clearance from the lock sleeve 360. Note that the locking ball 356 is not necessarily gravitationally pulled into contact with the radially outer periphery of the valve piston end portion 352. In some embodiments, the locking mechanism 168 may be configured such as to cause radially inward urging of the locking ball 356 into contact with the valve piston 212, e.g. by hydraulic action of the ambient fluid.

Figure 8B:
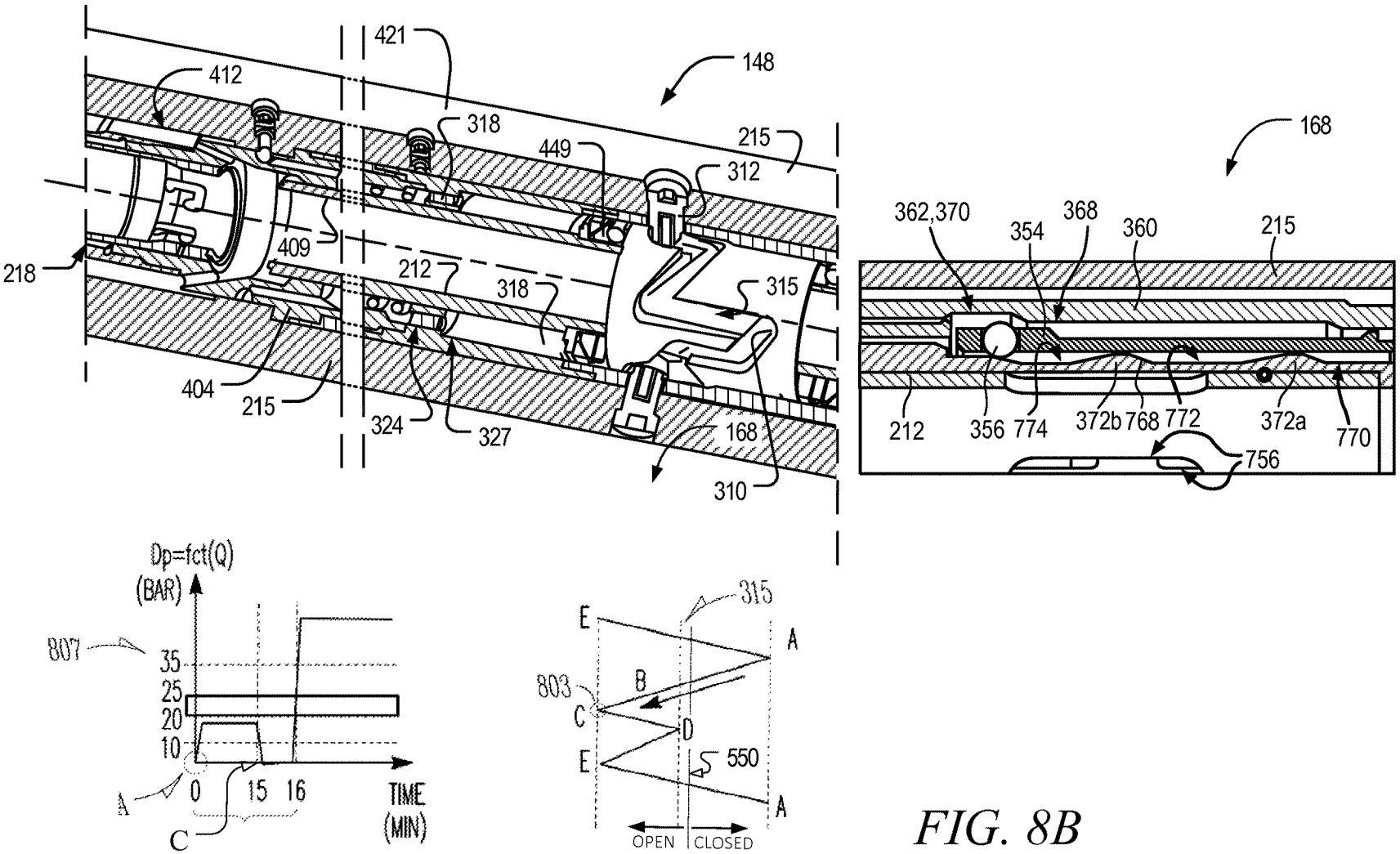
Figure 8C:
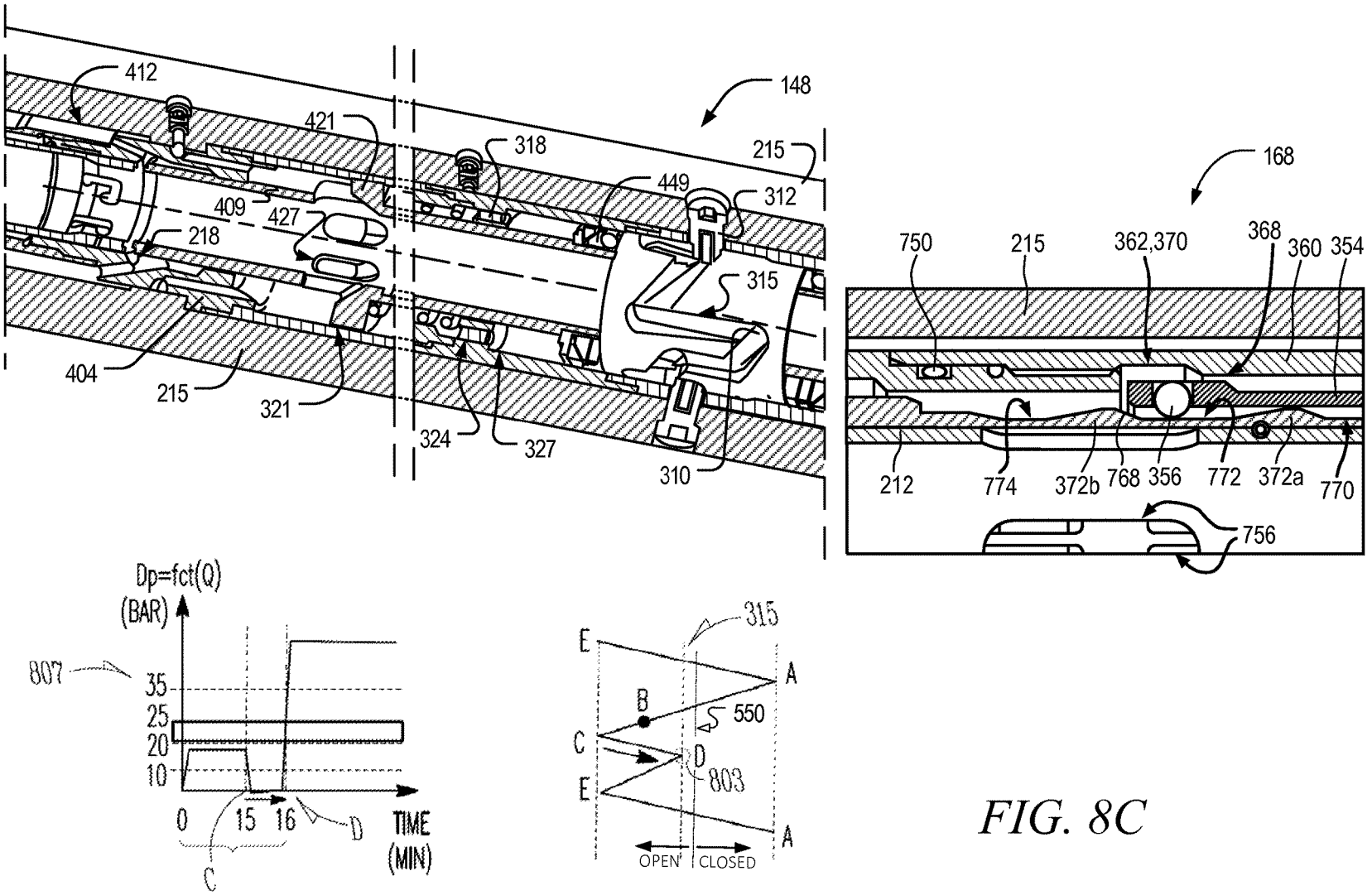

FIG. 8B shows the provision of fluid pressure conditions to change the controller 148 from the deactivated mode to the activated mode. In this example, drilling fluid control to switch to the activated mode comprises maintaining a bore-annulus pressure difference below a trigger threshold value of about 20 bar for at least a trigger threshold interval of about 15 minutes.

The various components of the controller 148 (e.g., the hydraulic features of the valve piston 212 and the lock piston 331, and the parameters of the closing spring 305 and the lock spring 334) are selected such that below a bore-annulus pressure difference of 20 bar (being the trigger threshold value in this example), net hydraulic forces on the lock piston 331 is insufficient to move the lock piston 331 downhole (i.e., rightwards in FIG. 8B) while net hydraulic forces on the valve piston 212 due to the bore-annulus pressure difference is greater than a maximum resistive force that can be exerted thereon by the closing spring 305, so that the valve piston 212 is hydraulically actuated to move longitudinally downhole (i.e., rightwards in FIG. 8B). Note that the axial orientations of various components of the controller 148 can in some embodiments be changed from the orientation of the illustrated example embodiment, so that the valve piston 212 and the lock piston 331 can in some embodiments be configured for axial displacement uphole under hydraulic actuation.

The valve piston 212's downhole movement is retarded by operation of the flow restrictor 318 that limits the rate of fluid transfer from the control fluid reservoir 321 across the chamber wall 430 to the draw chamber 327. The latch pin 312 thus moves from point A to point C, entering the latch slot 512 at point B. Note that the latch mechanism of the control arrangement provided by the controller 148 is changed from the deactivated mode to the activated mode when the latch pin 312 reaches point B, whereupon it enters the latch slot 512 (see FIG. 5). Thus, point B in this instance comprises a first mode change position of the latch pin 312, with a corresponding longitudinal position of the valve piston 212 comprising a mode change position of the valve piston 212. Note that, in this example, the valve opening/closing point represented by line 550 is reached before the mode change position of point B.

Because the lock piston 331 remains substantially stationary during the downhole travel of the valve piston 212 for mode change to occur, the locking ball 356 remains in the release portion 370 of the locking chamber 362, allowing first the leading hump 372*a* and then the trailing hump 372*b* to move past it due to the sufficient radial clearance provided by the cylindrical wall of the locking chamber 362 in the release portion 370. The locking ball 356 can thus move radially outwards due to contact with the leading slope 768 of the respective humps 372, clearing the apex and permitting unobstructed movement of the humps 372 axially past it. Thus, when the valve piston 212 is in its extreme downhole position, the locking ball 356 is in register with and/or seated on the rear landing 774 of the valve piston end portion 352.

Note further that cessation of the bore-annulus pressure difference before the latch pin 312 reaches point B in the track 315 would result in return of the latch pin 312 to point A due to uphole movement of the valve piston 212 under the urging of the closing spring 305. In such a case, the valve port 218 would have been opened and closed (at point 550), without changing the mode of the controller 148.

After provision of the mode switching pressure conditions illustrated in FIG. 8B, pumping of drilling fluid through the bore 128 may be ceased for at least a predefined interval. Note, again, that the valve piston 212 is urged towards its closed position in the absence of a bore-annulus pressure difference by the closing spring 305.

In this example, provision of a substantially zero bore-annulus pressure difference for a pressure cessation interval of about one minute (see pressure graph 807 in FIG. 8C) is sufficiently long to move the valve piston 212 to an extreme uphole position achievable by the valve piston 212 in the latched condition. This extreme uphole latched position corresponds to location of the latch pin 312 at point D (see the condition of the controller 148 shown in FIG. 8C). When the latch pin 312 reaches point D in the track 315, it passes the step 530 at that point and abuts against the walls of the track 315, resisting further uphole movement of the valve piston 212 under the bias of the closing spring 305. Due to abutment also against the step 530 at point D, the only available movement for the latch pin 312 from point D is along leg DE of the latch slot 512.

Note that point D is located to the left of line 550 in the pressure diagram 820 Therefore, when the latch pin 312 is at point D in the track 315, the valve closure sleeve 409 is clear of the valve port 218, exposing the reamer assembly 118 to bore pressures. The latch pin 312's only path of escape from the latch slot 512, to permit closing of the valve port 218, is to reach point E (comprising a mode change position) along leg DE, to thereafter enable sufficient uphole movement of the valve piston 212 for the latch pin 312 to again reach and pass the valve closure point represented by line 550.

As will presently be seen, however, if the movement of valve piston 212 is under hydraulic actuation due to a bore-annulus pressure difference greater than the trigger threshold value, downhole movement of the valve piston 212 is obstructed or stayed by the lock piston 331 before the latch pin 312 can reach point E along leg DE.

Figure 8D:
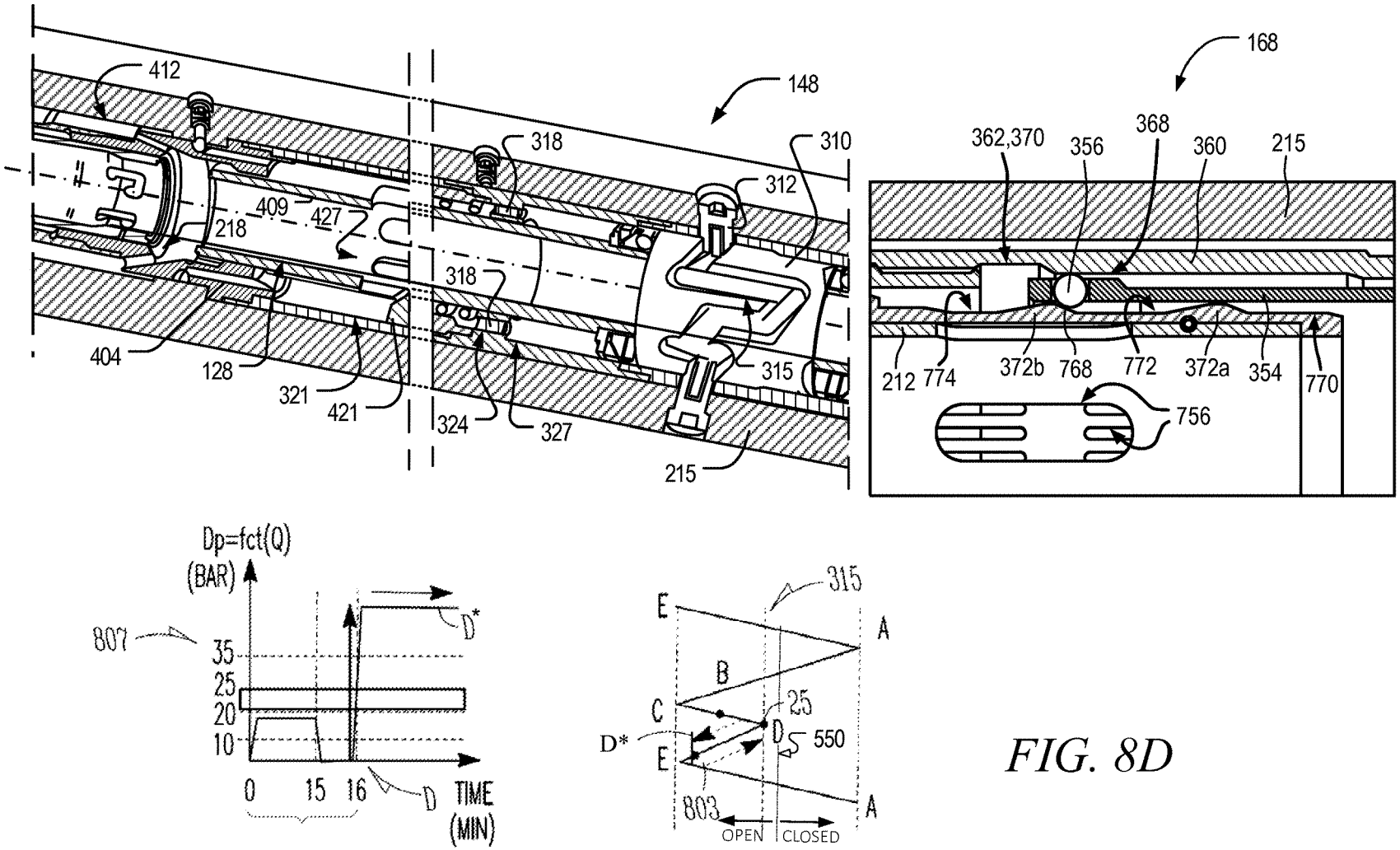

FIG. 8D shows an example instance where the bore-annulus pressure difference is ramped up beyond the trigger threshold value of between 20 and 25 bar of the present example. The pressure differential is thus now great enough for the lock piston 331 to overcome the resistance of the lock spring 334, so that both the valve piston 212 and the lock piston 331 are hydraulically impelled to move axially downhole, in this example embodiment being the opening direction of the valve piston 212. Because the speed of actuated movement of the valve piston 212 is limited by operation of the flow restrictor 318, the lock piston 331 moves downhole fast enough for the locking ball 356 to reach the constriction 366 and move into the constricted portion 368 of the locking chamber 362 before the trailing hump 372*b* of the valve piston end portion 352 arrives at the constriction 366.

When the trailing hump 372*b* comes into axial register with the entrance to the constricted portion 368 of the locking chamber 362, the leading slope 768 of the leading hump 372*a* meets the locking ball 356 and exerts a pushing force on the locking ball 356 at an angle substantially perpendicular to the contact surface provided by the leading slope 768 (see also FIG. 7). An axial component of these forces are resisted by abutment of the lock piston 331 against the shoulder 374, while a radial component is resisted by the cylindrical wall of the lock sleeve 360 in the constricted portion 368 of the locking chamber 362. Note that the locking ball 356 is thus effectively wedged between the outer periphery of the valve piston 212 and the inner periphery of the lock sleeve 360, due to the blocking action of the lock piston 331.

The axial spacing between the barrel cam 310 and the trailing hump 372*b* is such that the trailing hump 372*b* reaches the constricted portion 368 of the locking chamber 362 before the latch pin 312 has reached the mode change position of point E. The pin position at which the locking piston 331 blocks further downhole movement of the valve piston 212 from point D towards point E is indicated in FIG. 8D as point D*.

Operation of the locking mechanism 168 thus serves to block escape of the latch pin 312 from the latch slot 512 responsive to pressure conditions in which the bore-annulus pressure difference exceeds the trigger threshold value. The locking mechanism 168 thus locks the controller 148 in the activated mode, from which it can be switched to the deactivated mode only by application of the predefined trigger conditions.

Thus, the described latch mechanism and the lock piston 331 serve to dispose the controller 148 in the activated mode when the controller 148 is in the state shown in FIG. 8D, because the reamer 144 can be deployed substantially immediately when operational bore pressures are applied. This is because the valve port 218 remains open in response to the application of operational bore pressures (at which the bore-annulus pressure difference exceeds the trigger threshold value). If bore pressure is thereafter reduced, the latch pin 312 returns to point D, being trapped in the latch slot 512. The result is that the reamer assembly 118 is repeatedly and automatically deployable responsive to the application of operational bore pressures.

Note that even though the lock piston 331 is hydraulically actuated downhole against a greater spring resistance (providing by the lock spring 334) relative to the hydraulic actuating force is exerted on it than the spring resistance (provided by the closing spring 305) on the valve piston 212, arrival of the locking ball 356 at the constricted portion 368 of the locking chamber 362 is enabled and ensured by operation of the flow restrictor 318 which, as previously described, retards or governs the speed of movement of the valve piston 212.

Figure 8E:
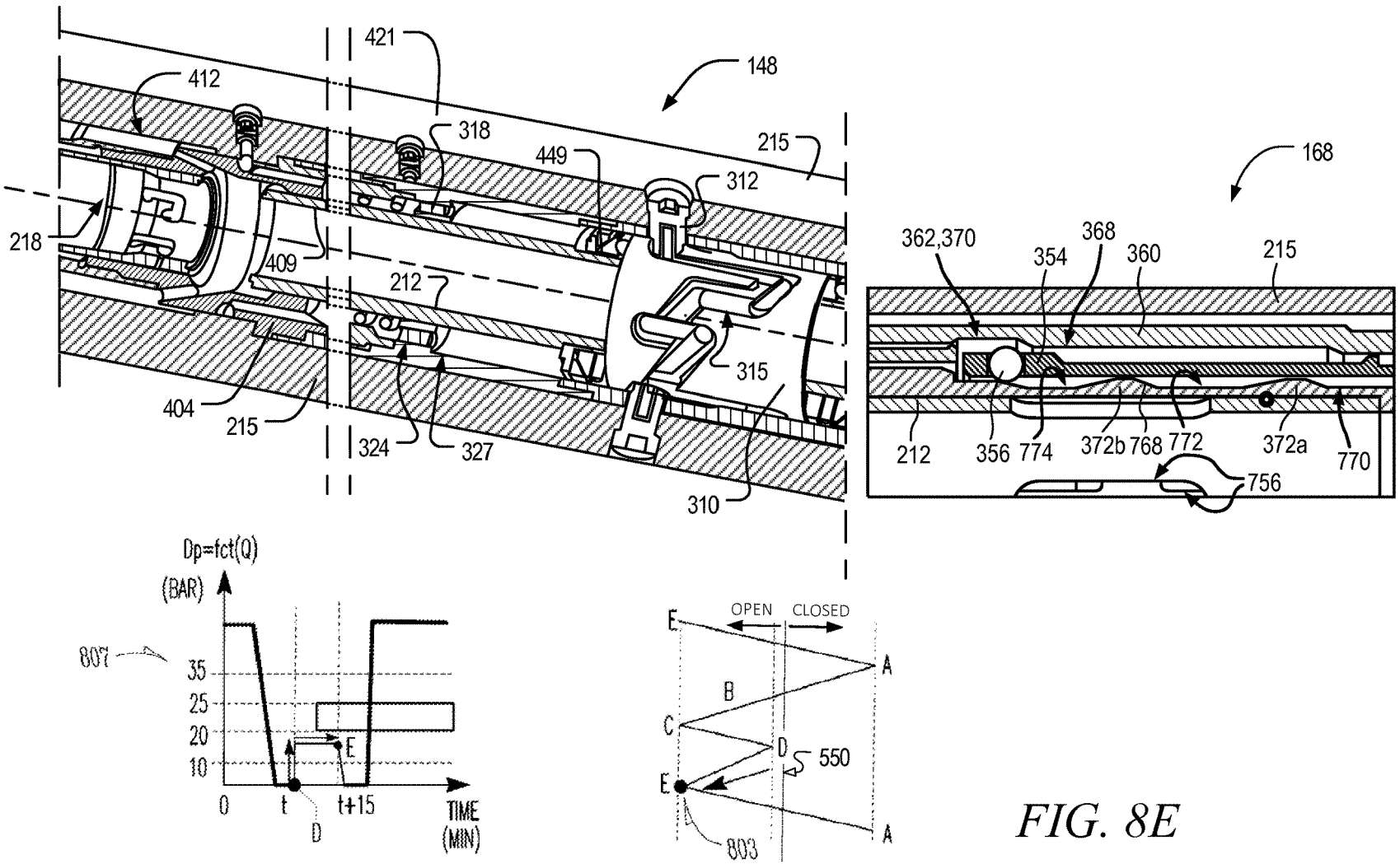
Figure 8F:
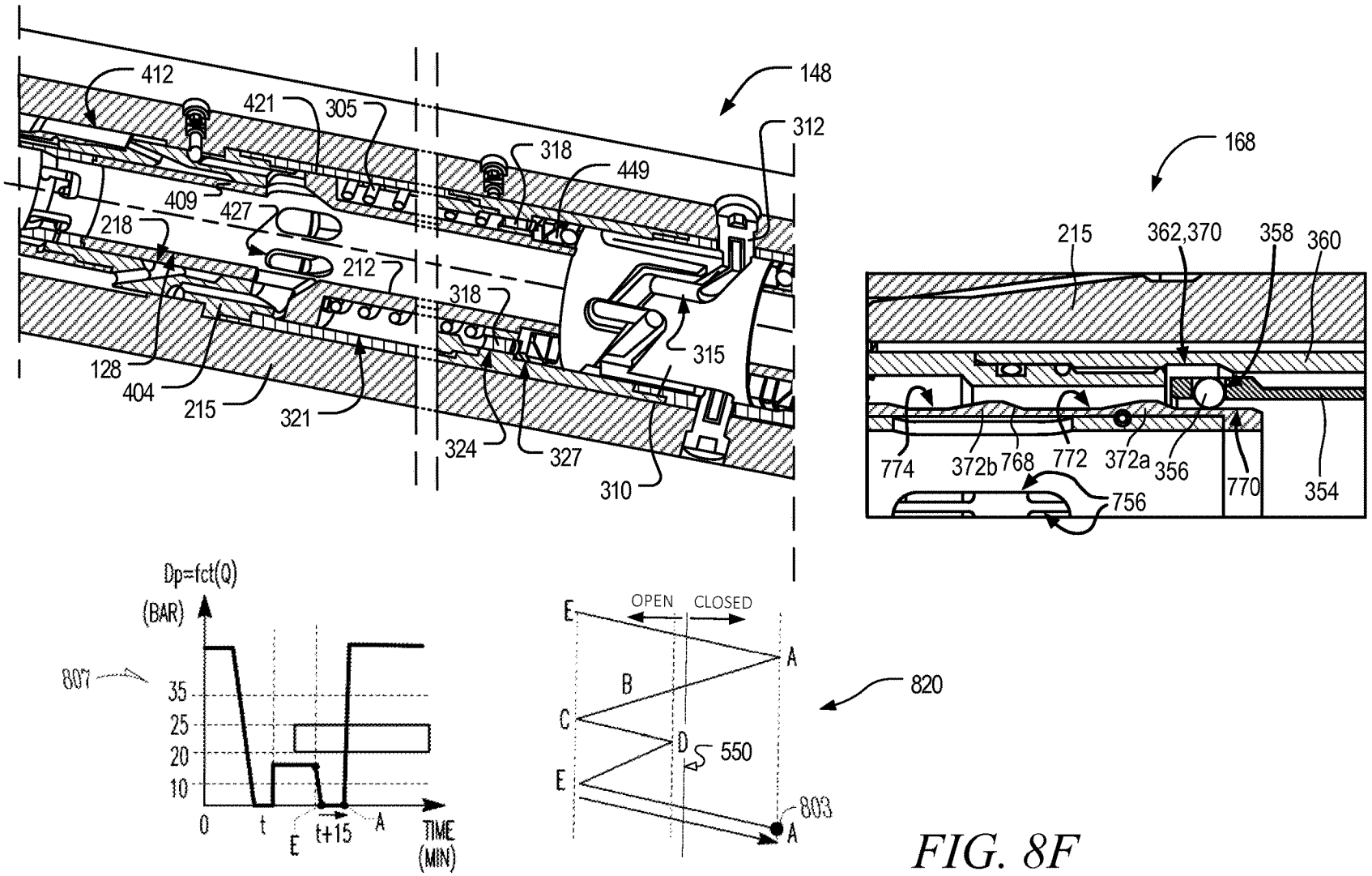

Escape of the latch pin 312 from the latch slot 512 is achievable only by provision of predefined mode change fluid pressure conditions. In this example, the mode change fluid pressure conditions to change from the activated mode to the deactivated mode are similar to those for changing from the deactivated mode to the activated mode. FIG. 8E shows pressure conditions controlled by an operator or automated system at the surface control system 140.

In this example, the bore pressure is selectively changed to provide a bore-annulus pressure difference below the trigger threshold value (here, for example, on the order of 20-25 bar) for at least a trigger threshold interval, again being about 15 minutes. As before, the lock piston 331 remains stationary in its rest position in which it clears the valve piston's 212 path (due to its being kept in the release portion 370 of the locking chamber 362 by the substantially stationary lock piston 331), to allow movement of the valve piston 212 to a mode change position corresponding to escape of the latch pin 312 from the latch slot 512 by passage of the latch pin 312 over the step 530 at point E. As is the case with each of points A-D, point E is effectively a point of no return for the latch pin 312 along the latch slot 512 due to fouling of the catch pin 618 on the corresponding step 530. During such movement of the valve piston 212 into the unlatching position corresponding to point E, the trailing hump 372*b* thus moves past the locking ball 356, with the locking ball 356 moving radially clear of the trailing hump 372*b* upon contact with the leading slope 768. Thus, when the latch pin 312 reaches point E, it is trapped in the unlatch slot 506, being movable from point E only along leg E-A of the track 315 towards point A. Note that the controller 148 is changed from the activated mode to the deactivated mode when the latch pin 312 enters the unlatch slot 506 at point E.

Once the latch pin 312 is in the unlatch slot 506, the valve piston 212 is, in the absence of hydraulic actuation, free to move longitudinally uphole (in this example embodiment being the closing direction) under the urging of the closing spring 305 in response to the provision of bore annulus pressure differences insufficient to resist the closing bias of the spring 305. Upon reduction of pressure levels subsequent to the arrival of the latch pin 312 at point E, the latch pin 312 moves from point E back to the starting position (point A), as shown schematically in FIG. 8F. In this example, the operator provides a bore-annulus pressure difference at or near zero bar after the 15 minute mode-switching low pressure interval (see FIG. 8E), resulting in automatic spring-actuated movement of the valve piston 212 uphole to its extreme uphole position in the unlatched condition (point A), with the valve port 218 closing when the latch pin 312 passes a point corresponding to line 550 in the pressure graph diagram 820 of FIG. 8F.

It will by now be appreciated that such uphole return of the valve piston 212 to the position in which the valve port 128 is closed is not obstructed by the locking mechanism 168. The locking ball 356 is kept in the release portion 370 of the locking chamber 362, allowing passage of the first the trailing hump 372*b* and then the leading hump 372*a* past it, to seat once again on the front landing 770.

Figure 8G:
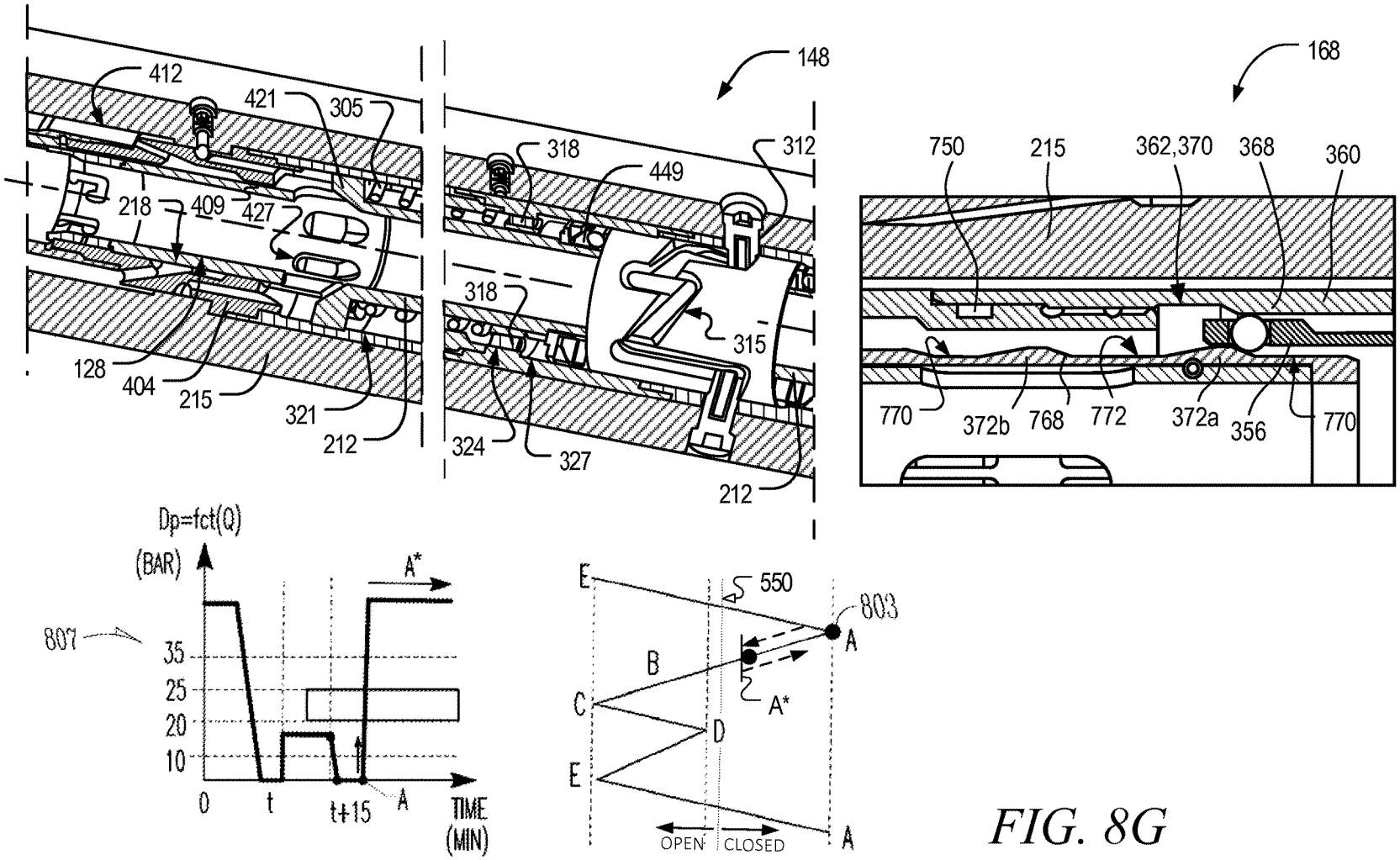

FIG. 8G shows operation of the lock piston 331 to keep the latch pin 312 in the unlatch slot 506 responsive to application of bore-annulus pressure differences above the trigger threshold value. The locking mechanism 168 therefore serves (absent provision of trigger threshold sequence/conditions) both to lock the controller 148 in the activated mode, and to lock the controller 148 in the deactivated mode, depending on the position of the latch pin 312 in the track 315.

When such a high operational pressure, at which the respective downhole tool is deployed (also referred to herein as operational tool pressures), is applied, the lock piston 331 moves downhole (in this example being the opening direction of the valve piston 212) under hydraulic actuation fast enough to reach the constriction 366 before the leading hump 372*a* of the valve piston 212 reaches the constriction 366. In this example embodiment, the lock piston 331 moves downhole faster than the valve piston 212.

As described previously with respect to the engagement of the trailing hump 372*b* with the locking ball 356, the locking ball 356 (now located in the constricted portion of the locking chamber 362) obstructs further movement of the valve piston 212 by wedging of the locking ball 356 between the valve piston 212 and the lock sleeve 360, being anchored against further downhole movement by the lock piston 331, via its abutment against the shoulder 374. In this manner, axial advance of the valve piston 212 is obstructed before it reaches the mode change position defined by point B. In this example, the valve piston 212 is stopped before the valve port 218 is opened, i.e., in this example before the latch pin 312 reaches line 550, indicated as point A* in FIG. 8G). Thus, the controller 148 is locked in the deactivated mode, the reamer assembly 118 being unresponsive to operational bore pressures.

After cessation of the above-threshold pressure levels, the lock piston 331 returns axially uphole (e.g., in the closing direction) under the urging of the lock spring 334. The locking ball 356 is thus moved back into the release portion 370 of the locking chamber 362, where it is in the clearing position. The state of the controller 148 is thus returned to its state described and discussed with reference to FIGS. 8A and 8G. Switching back into the activated mode can again occur only in response to provision of the trigger pressure sequence comprising application of a below-threshold pressure (sufficient to move the valve piston 212 in the opening direction) for at least the trigger interval.

By the above-described methods and systems, control of downhole tools exclusively through control of bore pressure is achieved. It is a benefit that, once the controller 148 is in the activated mode, the reamer assembly 118 (or any other downhole tool that may be connected to the controller 148 instead) may be deployed and retracted repeatedly simply by ramping up bore pressure. In the deactivated mode, drilling fluid pressures can be provided as required, without concern for inadvertent deployment of the relevant tool, e.g. the reamer assembly 118, because accidental application of the described mode switching bore conditions (e.g., continuous low flow/pressure for 15 minutes or more) is readily preventable.

Thus, a method and system control downhole tool activation by remote fluid pressure control have been described. Some embodiments provide a drilling apparatus a generally tubular housing to form an in-line part of an elongated drill string extending longitudinally along a borehole, the housing defining a longitudinally extending bore to convey drilling fluid under pressure, a bore-annulus pressure difference being defined between drilling fluid pressure in the bore and drilling fluid pressure in an annulus that radially spaces the housing from a borehole wall. A control arrangement may be mounted in the housing to control response of a downhole tool in the drill string to variations in the bore-annulus pressure difference, the control arrangement defining a valve port that is connectable to a hydraulic activation mechanism of the downhole tool (e.g., reamer assembly 118), the control arrangement further comprising a valve piston (e.g. valve piston 212) that is longitudinally displaceable in the housing to dispose the valve port between an open condition, to permit fluid pressure communication between the bore and the activation mechanism of the downhole tool, and a closed condition, to substantially isolate the activation mechanism from the bore. The example apparatus further comprises a latch mechanism (including, e.g., barrel cam 310 and latch pin 312) to releasably latch the valve piston to the housing to restrain relative longitudinal movement of the valve piston in a first longitudinal direction (in the example embodiment comprising movement in a closing direction, towards closure of the valve port, for example being uphole movement in the described example embodiments), the valve piston, when latched, being releasable by movement thereof in an opposite, second longitudinal direction (e.g., in a closing direction, being the downhole direction in the described embodiments) to a mode change position (e.g., by the latch pin 312 reaching mode change point E on the barrel cam 310, point B being a mode change position when valve piston 212 is unlatched). In this embodiment, latching or release of the valve piston changes an operational mode of the control arrangement between an activated mode in which the valve port in its open condition upon application of bore pressures at or above tool activation levels, to permit hydraulic tool activation, and a deactivated mode in which the valve port in its closed condition upon application of bore pressures at or above tool actuation levels, to prevent hydraulic tool activation.

The example drilling apparatus further comprises a stay member or lock member (e.g., lock piston 331) that is automatically displaceable under hydraulic actuation responsive to provision of the bore-annulus pressure difference above a trigger threshold value, to obstruct movement of the valve piston, when latched, under hydraulic actuation to the mode change position. In the described example embodiments, movement of the stay member (e.g., the lock piston 331) to obstruct movement of the valve piston comprises hydraulically actuated movement in same direction as is the case for hydraulically actuated movement of the valve piston.

Although the present invention has been described with reference to specific example embodiments, it will be evident that various modifications and changes may be made to these embodiments without departing from the broader spirit and scope of method and/or system. Accordingly, the specification and drawings are to be regarded in an illustrative rather than a restrictive sense.

For example, staying mechanisms different from the lock piston 331 may be employed to obstruct movement of the valve piston 212, in some embodiments. Note also that although the described control arrangement finds particularly beneficial application in combination with a reamer assembly, these techniques can profitably be employed in combination with a variety of other downhole tools, including, for example, adjustable gage stabilizers, jars, dump valves, valves, packers, flow control devices or any hydraulically actuated mechanism in which its state needs to be controlled at will from the surface.

The described example embodiments therefore disclose, inter alia, a well tool apparatus to control a downhole tool in a drill string which will extend longitudinally along a borehole, the well tool apparatus comprising a generally tubular housing configured to form an in-line part of the drill string, the housing defining a longitudinally extending bore to convey drilling fluid under pressure, a bore-annulus pressure difference being defined between drilling fluid pressure in the bore and drilling fluid pressure in an annulus that radially spaces the housing from walls defining the borehole; and a control arrangement mounted in the housing, the control arrangement being configured to control response of the downhole tool in response to variations in the bore-annulus pressure difference, the control arrangement defining a valve port that is connectable to a hydraulic activation mechanism of the downhole tool.

The control arrangement comprises: a valve piston that is longitudinally displaceable in the housing to dispose the valve port between an open condition which permits fluid pressure communication between the bore and the activation mechanism of the downhole tool, and a closed condition which substantially isolates the activation mechanism from the bore; and a latch mechanism configured to releasably latch the valve piston to the housing to restrain relative longitudinal movement of the valve piston in a first longitudinal direction, wherein the latched valve piston is releasable by movement thereof in an opposite, second longitudinal direction to a mode change position in which the an operational mode of the control arrangement changes between, on the one hand, an activated mode in which the valve port is in an open condition upon application of bore pressures at or above tool activation levels, to permit hydraulic tool activation, and, on the other hand, a deactivated mode in which the valve port is in a closed condition upon application of bore pressures at or above tool activation levels, to prevent hydraulic tool activation.

The control arrangement further comprises a stay member that is automatically displaceable under hydraulic actuation responsive to provision of the bore-annulus pressure difference above a trigger threshold value, to obstruct movement of the latched valve piston under hydraulic actuation to the mode change position.

The stay member may be a lock piston longitudinally aligned with the valve piston and being longitudinally displaceable under hydraulic actuation in the second longitudinal direction, in the same direction as movement of the valve piston under hydraulic actuation. In such a case, the control arrangement may further comprise a closing bias arrangement configured to urge the valve piston in the first longitudinal direction, towards closure of the valve port and against hydraulically actuated movement of the valve piston, and a staying bias arrangement configured to urge the stay member in the first longitudinal direction, away from the valve piston and against hydraulically actuated movement of the valve piston, the staying bias arrangement exerting a greater biasing force than the closing bias arrangement and being selected such that there is a range of bore-annulus pressure difference values at which hydraulically actuated movement of the lock piston is substantially prevented by the staying bias arrangement, while achieving hydraulically actuated movement of the valve piston against the closing bias arrangement.

The well tool apparatus may further comprise a retarding arrangement to retard hydraulically actuated movement of the valve piston in the second longitudinal direction, to facilitate obstructing engagement of the lock piston with the valve piston before the valve piston, when latched, reaches the mode change position. The retarding arrangement may comprise: a plurality of cooperating flow control chambers operatively connected to the valve piston such that longitudinal movement of the valve piston is dependent on corresponding fluid transfer between the cooperating flow control chambers; a fluid passage connecting at least two of the plurality of cooperating flow control chambers; and a flow restrictor in the fluid passage configured to restrict fluid flow between the flow control chambers to a predefined fluid flow rate in response to a pressure differential between the flow control chambers, thereby to limit hydraulically actuated longitudinal movement of the valve piston to a predefined speed.

The downhole tool may be a reamer assembly that comprises a tubular reamer body longitudinally aligned with and connected to the housing to place the activation mechanism of the reamer assembly in fluid pressure communication with the valve port, and one or more cutting elements mounted on the reamer body and configured to ream the borehole wall, the cutting elements being disposable responsive to bore pressure conditions between a deployed condition in which the one or more cutting elements project radially outwards from the reamer body to engage the borehole wall, and a retracted condition in which the one or more cutting elements are retracted to permit rotation of the reamer body free from engagement of the one or more cutting elements with the borehole wall.

The latch mechanism may be configured such that hydraulically actuated movement of the valve piston, when latched, in the second longitudinal direction from a latched rest position to the mode change position responsive to a substantially constant bore-annulus pressure difference is achievable only by provision of the bore-annulus pressure difference at a level below the trigger threshold value and for at least a trigger threshold interval.

The latch mechanism may comprise a barrel cam that is co-axially mounted on the valve piston, being rotatable about the valve piston and being anchored to the valve piston for longitudinal movement therewith, the barrel cam defining an elongated track recess in a radially outer surface thereof, the track recess extending circumferentially about the barrel cam at changing longitudinal positions, the latch mechanism further comprising a latch member mounted on the housing to project radially inwards therefrom, the latch member being received in the track recess in cam-following engagement with the track recess, the track recess being shaped such that longitudinal movement of the barrel cam relative to the latch member causes rotation of the barrel cam.

The track recess may comprise: a latch slot shaped such that, when the latch member is in the latch slot, closure of the valve port by longitudinal movement of the valve piston under urging of the closing bias arrangement is prevented by engagement of the latch member with the latch slot; and an unlatch slot shaped to permit movement of the latch member along it to a position in which the valve port is closed.

One aspect of the disclosure includes an apparatus that comprises a generally tubular housing configured for incorporation in a drill string which is to extend longitudinally along a borehole, the housing defining a longitudinally extending bore configured to convey drilling fluid through the housing;

a valve port configured for connection to a hydraulic tool activation mechanism of a tool incorporated in the drill string;

a valve piston that is longitudinally displaceable in the housing and that is configured to dispose the valve port from a closed condition to an open condition by longitudinal displacement of the valve piston in an opening direction, the valve port in the open condition permitting a fluid connection between the bore and the tool activation mechanism;

a latch mechanism configured for releasably latching the valve piston to the housing to restrain relative longitudinal movement of the valve piston, thereby to dispose the apparatus between operational modes comprising an activated mode in which the valve port is in the open condition upon application of drilling fluid pressures at or substantially above tool activation levels, and a deactivated mode in which the valve port is in the closed condition upon application of drilling fluid pressures at or substantially above tool activation levels, the latch mechanism being configured to switch from one of the operational modes to the other in response to longitudinal movement of the valve piston to a mode change position; and a stay member that is automatically displaceable in the opening direction under hydraulic actuation in response to provision of drilling fluid pressures substantially above a trigger threshold level, to obstruct movement of the valve piston to the mode change position.

In some embodiments, the stay member (e.g., a lock piston) is configured to allow unobstructed movement of the valve piston to the mode change position in response to provision of drilling fluid pressures at levels below the trigger threshold level for at least a trigger threshold interval. In such embodiments, the stay member may be configured for preventing, in response to provision of drilling fluid pressures substantially above the trigger threshold level, both (a) mode change from the activated mode to the deactivated mode, by obstructing movement of the valve piston in the opening direction before the valve piston reaches an unlatching position, and (b) mode change from the deactivated mode to the activated mode, by obstructing movement of the valve piston in the opening direction before the valve piston reaches a latching position. In some embodiments, the latch mechanism is configured to latch the mechanism in the activated mode by preventing return of the valve piston for movement thereof in a closing direction into a longitudinal position in which the valve port is in the closed condition, the closing direction being opposite to the opening direction.

In some embodiments, the valve piston and the lock piston overlap axially in at least an overlap portion, the lock piston carrying an obstruction element (e.g., one or more locking balls) that is located in the overlap portion and is configured to be movable by longitudinal movement of the lock piston between: (a) a clearing position in which relative longitudinal movement of the valve piston sufficient for movement to the mode change position is allowed, and (b) an obstructing position in which the obstruction element is configured to obstruct movement of the valve piston to the mode change position.

The lock piston may be configured to move the obstruction element from the clearing position to the obstructing position by hydraulically actuated longitudinal movement of the lock piston in the opening direction in response to provision of drilling fluid pressures substantially above the trigger threshold level. In such embodiments, the lock piston may further be configured to move the obstruction element, when the obstruction element is in the obstructing position, from the obstructing position to the clearing position by longitudinal movement of the lock piston in a closing direction opposite to the opening direction, in response to cessation of drilling fluid pressures substantially above the trigger threshold level.

In some embodiments, the lock piston is configured to keep the obstruction element in the clearing position in response to provision of drilling fluid pressures below the trigger threshold level. In some embodiments, the obstruction element is anchored to the lock piston for longitudinal movement therewith, and is radially displaceable relative to the valve piston in response to longitudinal movement between the obstructing position and the clearing position. In some embodiments, the obstruction element is held captive against radial escape from the valve piston by a radially outer periphery of the valve piston in the overlap portion and a radially inner periphery of a chamber wall incorporated in the housing and defining at least part of a locking chamber in which the obstruction element is located. The chamber wall of the of the locking chamber may in some embodiments be configured to define a release portion and a constricted portion, an inner diameter of the chamber wall being smaller in the constricted portion than in the release portion, the obstruction element being switchable from the clearing position to the obstructing position by longitudinal movement thereof from the release portion to the constricted portion caused by movement of the lock piston in the opening direction.

In some embodiments, the obstruction element is a roller configured for rolling along a radially outer periphery of the valve piston in the overlap portion. The roller may in some embodiments be a ball.

In some embodiments, the valve piston and the lock piston comprise substantially tubular parts mounted co-axially within the housing in end-to-end arrangement, the valve piston and lock piston having respective end portions that are telescopically received one within the other in the overlap portion, the obstruction element being located in a generally annular volume between a radially outer periphery of the valve piston and the housing. The valve piston may in such embodiments carry one or more interference formations (e.g., radially projecting protrusions, irregularities, or humps) in the overlap portion, each interference formation comprising a radial protrusion on a radially outer surface of the valve piston, the radial protrusion being configured for obstructive engagement with the obstruction element when it is located in the constricted portion of the locking chamber. Each interference formation may comprise an inclined contact surface configured for wedging engagement with the obstruction element in the obstructing position. In some embodiments, the one or more interference formations comprises a pair of axially spaced interference formations, one of the pair of interference formations being configured for obstructive engagement with the obstruction element to prevent movement of the valve piston, when latched, into the unlatching position, and the other one of the pair of interference formations being configured for obstructive engagement with the obstruction element to prevent movement of the valve piston, when unlatched, into the latching position.

In some embodiments, the downhole tool includes a reamer assembly that comprises:

a tubular reamer body longitudinally aligned with and connected to the housing to place the activation mechanism of the reamer assembly in fluid connection with the valve port; and one or more cutting elements mounted on the reamer body and configured to ream the borehole wall, the cutting elements being disposable responsive to bore pressure conditions between (a) a deployed condition in which the one or more cutting elements project radially outwards from the reamer body to engage the borehole wall, and (b) a retracted condition in which the one or more cutting elements are retracted to permit rotation of the reamer body free from engagement of the one or more cutting elements with the borehole wall.

Another aspect of the disclosure includes a method that comprises controlling operation of a downhole tool coupled in a drill string extending longitudinally along a borehole by controlling drill string pressure conditions to cause response by a control mechanism operatively coupled to the downhole tool and defining a valve port that is connectable to a hydraulic activation mechanism of the downhole tool, the control mechanism further comprising, at least:

(a) a valve piston that is longitudinally displaceable in the housing and that is configured to dispose the valve port from a closed condition to an open condition by longitudinal displacement of the valve piston in an opening direction, the valve port in the open condition permitting a fluid connection between the bore and the tool activation mechanism;

(b) a latch mechanism configured for releasably latching the valve piston to the housing to restrain relative longitudinal movement of the valve piston, thereby to dispose the control mechanism between operational modes comprising an activated mode in which the valve port is in the open condition upon application of drilling fluid pressures at or substantially above tool activation levels, and a deactivated mode in which the valve port is in the closed condition upon application of drilling fluid pressures at or substantially above tool activation levels, the latch mechanism being configured to switch from one of the operational modes to the other in response to longitudinal movement of the valve piston to a mode change position; and (c) a stay member that is automatically displaceable in the opening direction under hydraulic actuation in response to provision of drilling fluid pressures substantially above a trigger threshold level, to obstruct movement of the valve piston to the mode change position.

The controlling of the downhole tool may comprise causing the control mechanism to switch from the activated mode to the deactivated mode by providing drilling fluid pressures below the trigger threshold level for at least a trigger interval. In some embodiments, the controlling of the downhole tool comprises causing the control mechanism to switch from the deactivated mode to the activated mode by providing drilling fluid pressures below the trigger threshold level for at least a trigger interval.

The described embodiments further disclose a drilling installation which includes the well tool apparatus, as well as a method comprising use of the well tool apparatus.

The preceding detailed description describes example embodiments of the disclosure with reference to the accompanying drawings, which depict various details of examples that show how the disclosure may be practiced. The discussion addresses various examples of novel methods, systems and apparatuses in reference to these drawings, and describes the depicted embodiments in sufficient detail to enable those skilled in the art to practice the disclosed subject matter. Many embodiments other than the illustrative examples discussed herein may be used to practice these techniques. Structural and operational changes in addition to the alternatives specifically discussed herein may be made without departing from the scope of this disclosure.

In this description, references to "one embodiment" or "an embodiment," or to "one example" or "an example" in this description are not intended necessarily to refer to the same embodiment or example; however, neither are such embodiments mutually exclusive, unless so stated or as will be readily apparent to those of ordinary skill in the art having the benefit of this disclosure. Thus, a variety of combinations and/or integrations of the embodiments and examples described herein may be included, as well as further embodiments and examples as defined within the scope of all claims based on this disclosure, as well as all legal equivalents of such claims.

In the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate embodiment.

What is claimed is:

1. An apparatus comprising:

a generally tubular housing configured for incorporation in a drill string which is to extend longitudinally along a borehole, the housing defining a longitudinally extending bore configured to convey drilling fluid through the housing;

a valve port configured for connection to a hydraulic tool activation mechanism of a tool incorporated in the drill string;

a valve piston that is longitudinally displaceable in the housing and that is configured to dispose the valve port from a closed condition to an open condition by longitudinal displacement of the valve piston in an opening direction, the valve port in the open condition permitting a fluid connection between the bore and the tool activation mechanism;

a latch mechanism configured for releasably latching the valve piston to the housing to restrain relative longitudinal movement of the valve piston, thereby to dispose the apparatus between operational modes comprising an activated mode in which the valve port is in the open condition upon application of drilling fluid pressures at or substantially above tool activation levels, and a deactivated mode in which the valve port is in the closed condition upon application of drilling fluid pressures at or substantially above tool activation levels, wherein the latch mechanism is configured to switch from one of the operational modes to the other in response to longitudinal movement of the valve piston to a mode change position;

a stay member that is automatically displaceable in the opening direction under hydraulic actuation in response to provision of drilling fluid pressures substantially above a trigger threshold level, to obstruct movement of the valve piston to the mode change position; and wherein the stay member is configured to allow unobstructed movement of the valve piston to the mode change position in response to provision of drilling fluid pressures at levels below the trigger threshold level for at least a trigger threshold interval.

2. The apparatus of claim 1, wherein the stay member is configured for preventing, in response to provision of drilling fluid pressures substantially above the trigger threshold level, both:

mode change from the activated mode to the deactivated mode, by obstructing movement of the valve piston in the opening direction before the valve piston reaches an unlatching position; and mode change from the deactivated mode to the activated mode, by obstructing movement of the valve piston in the opening direction before the valve piston reaches a latching position.

3. The apparatus of claim 2, wherein the latch mechanism is configured to latch the mechanism in the activated mode by preventing return of the valve piston for movement thereof in a closing direction into a longitudinal position in which the valve port is in the closed condition, the closing direction being opposite to the opening direction.

4. The apparatus of claim 2, wherein the valve piston and the lock piston overlap axially in at least an overlap portion, the lock piston carrying an obstruction element that is located in the overlap portion and is configured to be movable by longitudinal movement of the lock piston between a clearing position in which relative longitudinal movement of the valve piston sufficient for movement to the mode change position is allowed, and an obstructing position in which the obstruction element is configured to obstruct movement of the valve piston to the mode change position.

5. The apparatus of claim 4, wherein the lock piston is configured: to move the obstruction element from the clearing position to the obstructing position by hydraulically actuated longitudinal movement of the lock piston in the opening direction in response to provision of drilling fluid pressures substantially above the trigger threshold level; and wherein the lock piston is configured to move the obstruction element, when the obstruction element is in the obstructing position, from the obstructing position to the clearing position by longitudinal movement of the lock piston in a closing direction opposite to the opening direction, in response to cessation of drilling fluid pressures substantially above the trigger threshold level.

6. The apparatus of claim 4, wherein the lock piston is configured to keep the obstruction element in the clearing position in response to provision of drilling fluid pressures below the trigger threshold level.

7. The apparatus of claim 4, wherein the obstruction element is anchored to the lock piston for longitudinal movement therewith, and is radially displaceable relative to the valve piston in response to longitudinal movement between the obstructing position and the clearing position.

8. The apparatus of claim 7, wherein the obstruction element is held captive against radial escape from the valve piston by a radially outer periphery of the valve piston in the overlap portion and a radially inner periphery of a chamber wall incorporated in the housing and defining at least part of a locking chamber in which the obstruction element is located.

9. The apparatus of claim 8, wherein the chamber wall of the locking chamber is configured to define a release portion and a constricted portion, an inner diameter of the chamber wall being smaller in the constricted portion than in the release portion, the obstruction element being switchable from the clearing position to the obstructing position by longitudinal movement thereof from the release portion to the constricted portion caused by movement of the lock piston in the opening direction.

10. The apparatus of claim 4, wherein the obstruction element is a roller configured for rolling along a radially outer periphery of the valve piston in the overlap portion.

11. The apparatus of claim 4, wherein the obstruction element is a ball.

12. The apparatus of claim 4, wherein the valve piston and the lock piston comprise substantially tubular parts mounted co-axially within the housing in end-to-end arrangement, the valve piston and lock piston having respective end portions that are telescopically received one within the other in the overlap portion, the obstruction element being located in a generally annular volume between a radially outer periphery of the valve piston and the housing.

13. The apparatus of claim 4, wherein the valve piston carries one or more interference formations in the overlap portion, each interference formation comprising a radial protrusion on a radially outer surface of the valve piston, the radial protrusion being configured for obstructive engagement with the obstruction element when it is located in the constricted portion of the locking chamber.

14. The apparatus of claim 13, wherein each interference formation comprises an inclined contact surface configured for wedging engagement with the obstruction element in the obstructing position.

15. The apparatus of claim 13, wherein the one or more interference formations comprises a pair of axially spaced interference formations, one of the pair of interference formations being configured for obstructive engagement with the obstruction element to prevent movement of the valve piston, when latched, into the unlatching position, and the other one of the pair of interference formations being configured for obstructive engagement with the obstruction element to prevent movement of the valve piston, when unlatched, into the latching position.

16. The apparatus of claim 1, herein the downhole tool comprises a reamer assembly, the reamer assembly comprising:

a tubular reamer body longitudinally aligned with and connected to the housing to place the activation mechanism of the reamer assembly in fluid connection with the valve port; and one or more cutting elements mounted on the reamer body and configured to ream the borehole wall, the cutting elements being disposable responsive to bore pressure conditions between, a deployed condition in which the one or more cutting elements project radially outwards from the reamer body to engage the borehole wall, and a retracted condition in which the one or more cutting elements are retracted to permit rotation of the reamer body free from engagement of the one or more cutting elements with the borehole wall.

17. A method comprising:

controlling operation of a downhole tool coupled in a drill string extending longitudinally along a borehole by controlling drill string pressure conditions to cause response by a control mechanism operatively coupled to the downhole tool and defining a valve port that is connectable to a hydraulic activation mechanism of the downhole tool, the control mechanism further comprising, a valve piston that is longitudinally displaceable in a generally tubular housing defining a longitudinally extending bore, the valve piston configured to dispose the valve port from a closed condition to an open condition by longitudinal displacement of the valve piston in an opening direction, the valve port in the open condition permitting a fluid connection between the bore and the tool activation mechanism;

a latch mechanism configured for releasably latching the valve piston to the housing to restrain relative longitudinal movement of the valve piston, thereby to dispose the control mechanism between operational modes comprising an activated mode in which the valve port is in the open condition upon application of drilling fluid pressures at or substantially above tool activation levels, and a deactivated mode in which the valve port is in the closed condition upon application of drilling fluid pressures at or substantially above tool activation levels, the latch mechanism being configured to switch from one of the operational modes to the other in response to longitudinal movement of the valve piston to a mode change position;

a stay member that is automatically displaceable in the opening direction under hydraulic actuation in response to provision of drilling fluid pressures substantially above a trigger threshold level, to obstruct movement of the valve piston to the mode change position; and wherein the stay member is configured to allow unobstructed movement of the valve piston to the mode change position in response to provision of drilling fluid pressures at levels below the trigger threshold level for at least a trigger threshold interval.

18. The method of claim 17, wherein the controlling of the downhole tool comprises causing the control mechanism to switch from the activated mode to the deactivated mode by providing drilling fluid pressures below the trigger threshold level for at least a trigger interval.

19. The method of claim 18, wherein the controlling of the downhole tool comprises causing the control mechanism to switch from the deactivated mode to the activated mode by providing drilling fluid pressures below the trigger threshold level for at least a trigger interval.

* * * * *